US010205289B2

(12) United States Patent
Tsai

(10) Patent No.: US 10,205,289 B2
(45) Date of Patent: Feb. 12, 2019

(54) ELECTRICAL CONNECTOR

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 0 days.

(21) Appl. No.: 15/512,338

(22) PCT Filed: Sep. 18, 2015

(86) PCT No.: PCT/CN2015/089964
§ 371 (c)(1),
(2) Date: Mar. 17, 2017

(87) PCT Pub. No.: WO2016/041522
PCT Pub. Date: Mar. 24, 2016

(65) Prior Publication Data

US 2017/0279234 A1 Sep. 28, 2017

(30) Foreign Application Priority Data

Sep. 19, 2014 (CN) ..... 2014 2 0541663 U

(51) Int. Cl.

| | |
|---|---|
| ***H01R 24/60*** | (2011.01) |
| ***H01R 13/6585*** | (2011.01) |
| *H01R 107/00* | (2006.01) |
| *H01R 43/16* | (2006.01) |

(52) U.S. Cl.
CPC ..... *H01R 24/60* (2013.01); *H01R 13/6585* (2013.01); *H01R 43/16* (2013.01); *H01R 2107/00* (2013.01)

(58) Field of Classification Search
CPC ..... H01R 43/16; H01R 43/24; H01R 43/20; H01R 13/405
USPC ..... 29/883, 884
See application file for complete search history.

(56) References Cited

U.S. PATENT DOCUMENTS 9,490,601 B2 * 11/2016 Zebhauser ..... H01R 43/16

* cited by examiner

*Primary Examiner* — Ross N Gushi
(74) *Attorney, Agent, or Firm* — WPAT, PC

(57) ABSTRACT

The invention provides an electrical connector, comprising: an insulated seat provided with a base seat and a jointing portion, which is provided with at least one connection surface; and at least one row of terminals, wherein the at least one row of terminals are arranged and connected to a material tape, wherein the material tape and the one row of terminals are formed by pressing the same metal sheet, the one row of terminals are fixed to the insulated seat and then separated from the material tape, the terminal is provided with a contact and a pin, the contact is exposed from the connection surface, and the pin extends out of the insulated seat; characterized in that the material tape is integrally connected to at least one metal material sheet and fixedly combined with the insulated seat, one end of the at least one metal material sheet is separated from the material tape to form one separated section exposed from the insulated seat, and the at least one metal material sheet is left and fixed to the insulated seat.

16 Claims, 32 Drawing Sheets

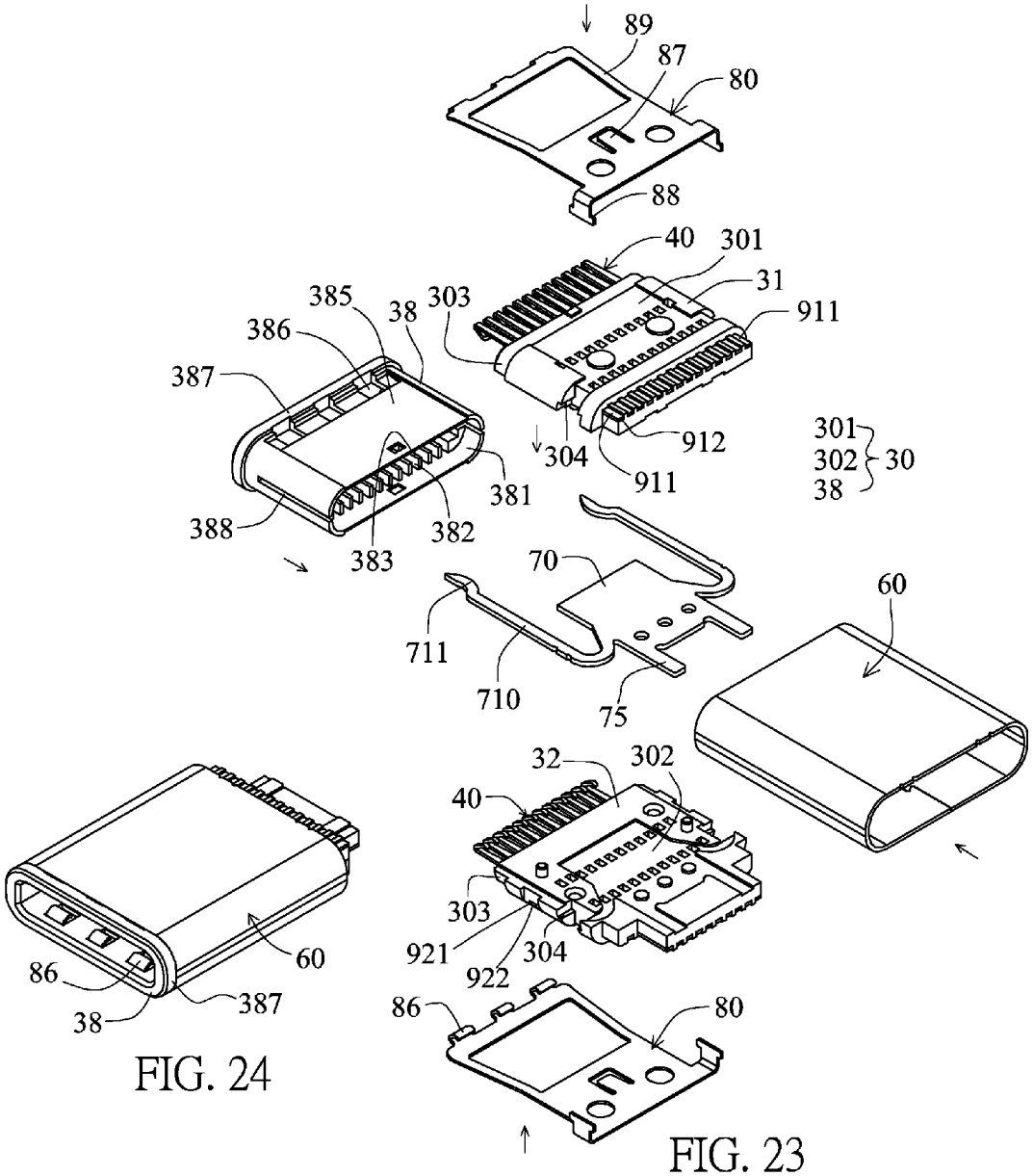
FIG. 24
FIG. 23
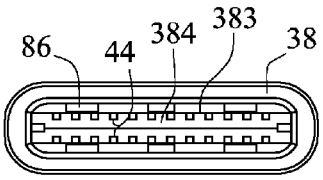
FIG. 25
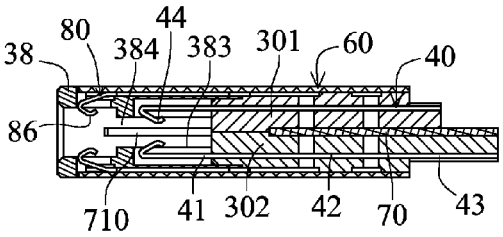
FIG. 26

ELECTRICAL CONNECTOR

BACKGROUND OF THE INVENTION

Field of the Invention

The invention relates to an electrical connector, and more particularly to an electrical connector beneficial to the automatic machine assembling processes.

Description of the Related Art

Regarding the manufacturing of the electrical connector, the plastic seat after being combined with terminals, is in the form of a single entity. When the next assembling process is entered, the artificial process needs to be adopted. Thus, the artificial assembly cannot achieve a series of automation processes, and becomes more time and labor consumptive. In addition, a vibration machine may also be adopted to place the single form of plastic seat and terminals onto the assembling machine by way of vibration, so that the vibration machine process and vibration machine cost are increased.

In order to improve the assembling processes of the electrical connector to be more beneficial to the automatic machine assembling processes, the inventor continues to improve research and development excellence and thus developed the invention.

SUMMARY OF THE INVENTION

A main object of the invention is to provide an electrical connector having an insulated seat fixedly provided with separated metal material sheets, each provided with a separated section exposed from the insulated seat. The insulated seat can be connected to a material tape through the at least one metal material sheet to achieve the convenience of the manufacturing and assembling processes.

Another main object of the invention is to provide an electrical connector having an insulated seat, which can combined with at least two metal material sheets through at least two left-right symmetrical slots, and can be connected to a material tape to achieve the convenience of the manufacturing and assembling processes.

Another main object of the invention is to provide a semi-finished product of an electrical connector having an insulated seat, which can be connected to a material tape through at least one metal material sheet to achieve the convenience of the manufacturing and assembling processes.

To achieve the above-identified objects, the invention provides an electrical connector, comprising: an insulated seat provided with a base seat and a jointing portion, which is provided with at least one connection surface; and at least one row of terminals, wherein the at least one row of terminals are arranged and connected to a material tape, wherein the material tape and the one row of terminals are formed by pressing the same metal sheet, the one row of terminals are fixed to the insulated seat and then separated from the material tape, the terminal is provided with a contact and a pin, the contact is exposed from the connection surface, and the pin extends out of the insulated seat; characterized in that the material tape is integrally connected to at least one metal material sheet and fixedly combined with the insulated seat, one end of the at least one metal material sheet is separated from the material tape to form one separated section exposed from the insulated seat, and the at least one metal material sheet is left and fixed to the insulated seat.

The invention further provides an electrical connector, comprising: an insulated seat provided with a base seat and a jointing portion, which is provided with at least one connection surface; and at least one row of terminals, wherein the at least one row of terminals is arranged and connected to a material tape, wherein the material tape and the one row of terminals are formed by pressing the same metal sheet, the one row of terminals are fixed to the insulated seat and then separated from the material tape, the terminal is provided with a contact and a pin, the contact is exposed from the connection surface, and the pin extends out of the insulated seat; characterized in that the material tape is provided with at least one metal material sheet connected to the insulated seat, the insulated seat is separated from the at least one metal material sheet to form at least one slot, and the at least one slot is open on an edge of the insulated seat.

The invention further provides a semi-finished product of an electrical connector, comprising: an insulated seat provided with a base seat and a jointing portion, which is provided with at least one connection surface; one row of terminals fixed to the insulated seat, wherein the terminal is provided with a contact and a pin, the contact is exposed from the connection surface, and the pin extends from the base seat out of the outside of the insulated seat; and a material tape, wherein the material tape and the one row of terminals are formed by pressing the same metal sheet, characterized in that the material tape is separated from the one row of terminals, and the material tape is integrally connected to at least one metal material sheet fixedly combined with the insulated seat.

With the above-mentioned structure, the invention has the following advantages.

1. The insulated seat can be connected to a material tape through the at least two metal material sheets to achieve the convenience of the manufacturing and assembling processes.

2. The insulated seat can be combined with at least two metal material sheets through the at least two left-right symmetrical slots, and can be connected to a material tape to achieve the convenience of the manufacturing and assembling processes.

3. The insulated seat can be connected to a material tape through at least one metal material sheet to achieve the convenience of the manufacturing and assembling processes.

BRIEF DESCRIPTION OF THE DRAWINGS

The above and other objects, advantages and features of the invention will become better understood with regard to the following detailed description of the preferred embodiments.

FIG. 23 is a pictorially exploded view according to the third embodiment of the invention.

FIG. 24 is a pictorially assembled view according to the third embodiment of the invention.

FIG. 25 is a cross-sectional front view according to the third embodiment of the invention.

FIG. 26 is a side cross-sectional view according to the third embodiment of the invention.

DETAILED DESCRIPTION OF THE INVENTION

Figure 1:
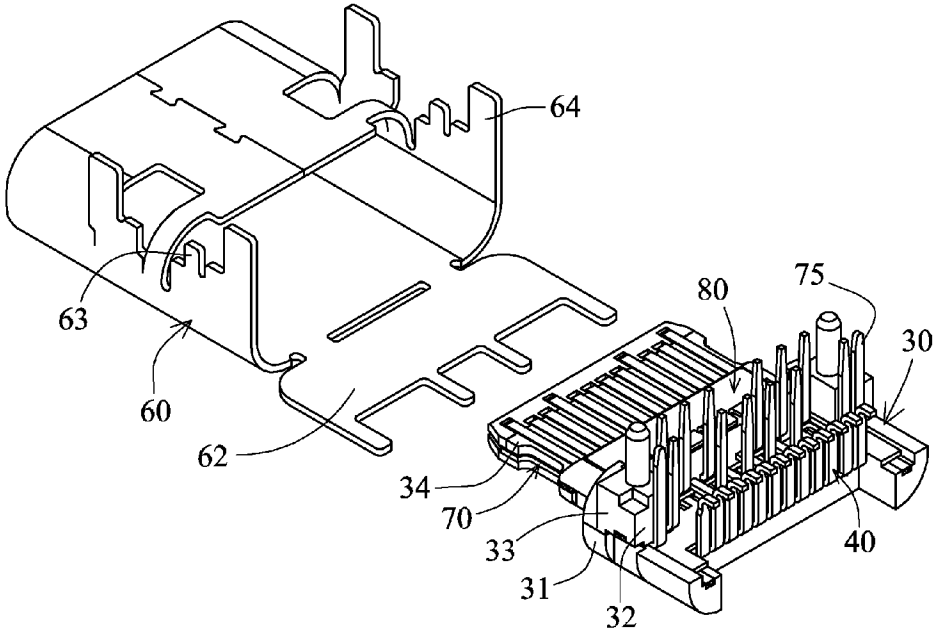
FIG. 1 is a pictorially exploded view according to a first embodiment of the invention.
Figure 2:
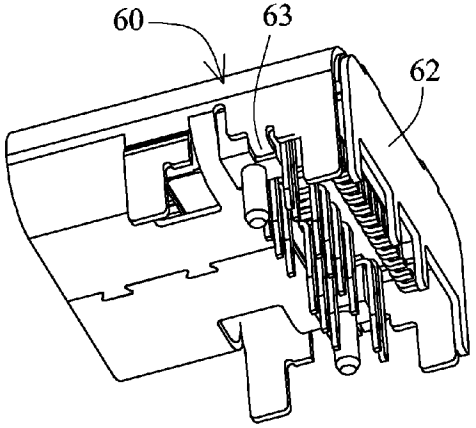
FIG. 2 is a pictorially assembled view according to the first embodiment of the invention.

Referring to FIGS. 1 to 5, this embodiment is a C-TYPE USB (Universal Serial Bus) electrically connected to a socket. The C-TYPE USB comprises an insulated seat 30, two rows of terminals 40, a metal housing 60, a metal partition plate 70 and two grounding sheets 80.

The insulated seat 30 is made of a plastic material and provided with a base seat 33 and a jointing portion 34. The front end of the base seat 33 is projectingly provided with the tongue-like jointing portion 34. The two opposite surfaces of the larger area of the jointing portion 34 are two connection surfaces. The thickness of the base seat 33 is larger than that of the jointing portion 34. The rear section of the jointing portion 34 is thicker than the front section so that the rear sections of the two connection surfaces are in the form of two grounding convex surfaces. From the two grounding convex surfaces to the outer surface of the base seat are provided with concave surfaces 307. The insulated seat 30 is provided with a first seat 31 and a second seat 32 vertically stacked. The first and second seats 31 and 32 are embedded and injection molded with the one row of first terminals 40, respectively. The first seat 31 is formed with a jointing portion and an upper portion of the base seat. The second seat 32 is formed with a jointing portion and a lower portion of the base seat. The front end of the jointing portion of the first seat 31 projects downwardly to form the full height of the front edge of the jointing portion 34 and form a convex surface 313 on the jointing surface. The front end of the jointing portion of the first seat 31 is provided with one row of eight slots 315, and each of two sides thereof is provided with a slot 314. The convex surface 313 is provided with one row of four space providing slots 316. Each of two sides of the middle section of the jointing portion of the first seat 31 provided with a notch 317, and the jointing surface is provided with a projection 318. Each of two sides of the middle section of the jointing portion of the second seat 32 is provided with a notch 323. Each of the base seats of the first and second seats 31 and 32 on the left and right sides of the vertical surface of the concave surface 307 is provided with a slot 35.

The two rows of terminals 40 are embedded and injection molded with the first and second seats 31 and 32, respectively, so that each of the jointing surfaces of the jointing portions of the first and second seats 31 and 32 is formed with two rows of concave holes 308, and each of the base seats of both is formed with one row of through holes 309. The terminal 40 is integrally pressed and bent to provide an extension 41, a fixing portion 42 and a pin 43. Partial top and bottom surfaces of the fixing portion 42 are embedded and fixed into the base seat. Each through hole 309 is passed by the fixing portion 42 of one terminal 40. The extension 41 is connected to the front end of the fixing portion 42 and extends to the jointing portion. The inner surface of the extension 41 is embedded into, in flat surface contact with and fixed to the jointing portion. The outer surface of the extension is exposed from the outer surface of the jointing portion to form a contact 44. So, the extension 41 is fixed and elastically non-movable. Each concave hole 308 corresponds to the extension 41 of one terminal 40. The pin 43 is connected to the rear end of the fixing portion 42, extends out of the base seat and has a horizontal distal section. The pins 43 of the one row of terminals 40 of the first seat 31 are disposed on the outer side and have horizontal distal sections arranged in one row. The pins 43 of the one row of terminals 40 of the second seat 31 are disposed on the inner side and have vertical distal sections arranged in front and rear rows. The contacts 44 of the two rows of terminals 40 are disposed on two connection surfaces of the jointing portion 34, respectively, and are vertically aligned. The contacts 44 of the two rows of terminals 40 have the same contact interface, and the contact interfaces have connection points with circuit serial numbers arranged reversely. The contacts 44 of each one row of terminals 40 have the lengths classified into four long one and eight short ones, and the lengths of the contacts 44 of the two rows of terminals are correspondingly arranged reversely. The front ends of the terminals 40 of the eight shorter contacts of the second seat 32 are convex upwardly to provide engaging projections 46 projecting above the front end. The front ends of the terminal 40 of the four longer contacts horizontally project beyond the front end.

In a C-TYPE USB specified by USB Association, two side terminals of the two rows of terminals are two grounding terminals. Furthermore, FIGS. 64 and 65 also illustrate that two side terminals of the two rows of terminals are two grounding terminals. Referring back to FIGS. 1 to 5, each of the left and right sides of the front end of the metal partition plate 70 is frontwardly and projectingly provided with an engaging plate 71, and a resting front edge 72 is provided between the two engaging plates 71. Each of the left and right sides of the metal partition plate 17 is provided with a depressed slot 73 and a separated section 76, the middle thereof is provided with an opening 74, and the rear end thereof is provided with two notches 77 and extends downwards to provide two pins 75.

The metal partition plate 70 is assembled between the first and second seats 31 and 32. The engaging plate 71 engages with the slot 314 of the first seat 31, and the resting front edge 72 rests against the rear edge of the convex surface 313. The opening 74 engages with the projection 318 and functions as a frontward limit of the metal partition plate 70. The second seat 31 engages with the notch 77 of the rear end of the metal partition plate 70 and functions as a backward limit of the metal partition plate 70. The engaging projections 46 of the terminal 40 of the eight shorter contacts of the second seat 32 engage into the slots 315 of the first seat 31. The front ends of the terminal 40 of the four longer contacts are connected to the space providing slots 316. The front edge of the jointing portion of the second seat 32 is connected and flush with the convex surface 313. The notches 317 and 323 of the first and second seats 31 and 32 are aligned with the slots 73 of the metal partition plate 70. The two pins 75 of the metal partition plate 70 extend out of the insulated seat 30.

The grounding sheet 80 is made of a metal material and provided with first and second plate sheets 81 and 82 in the form of a ladder shape, wherein a vertical sheet 85 is disposed between the first and second plate sheets 81 and 82, and each of two sides thereof is projectingly provided with a barb-shaped locking portion 83. The middle section of the top end of the vertical sheet 85 is connected to the second plate sheet 82, and each of two sides thereof is in the form of a separated section 84. The two grounding sheets 80 are assembled with and disposed on two concave surfaces 307 of the insulated seat 30 in the vertical direction. The second plate sheet 82 is in flat surface contact with the outer surface of the base seat 33. The first plate sheet 81 is in flat surface contact with the grounding convex surface of the jointing portion 33. The locking portion 83 is locked in the slot 35.

The metal housing 60 covers the insulated seat 30. The metal housing 30 and the base seat 33 rest against and engage with each other, and the inner front section thereof is formed with a connection slot 61, which covers the jointing portion 34, and into which the fitting portion of an electrical connection plug can be inserted. The jointing portion 34 is horizontally disposed at a middle height of the connection slot 61 and extends frontwards. The inlet of the connection slot 61 faces frontwards. Two symmetrical surfaces of the jointing portion 34 form symmetrical spaces. The connection slot 61 has the top-bottom symmetrical and left-right symmetrical shape and has two arced sides to approach a rectangle. Thus, the connection slot and the jointing portion can dock with an electrical connector in a dual-position bidirectional manner. The metal housing 60 is provided with a rear plate 62 disposed in back of the insulated seat 30, and each of left and right sides is provided with a locking sheet 63 and two plate connecting sheets 64. The locking sheet 63 is bent and locked into bottom ends of the left and right sides of the insulated seat 30. The plate connecting sheet 64 is vertical. In addition, the front end of the metal housing 60 is provided with two separated sections 68.

This embodiment is characterized in that each of the two sides of the base seat of the first seat 31 is provided with a metal material sheet 911. The two metal material sheets 911 are disposed on two outer sides of the one row of terminals 40 and are separated from the one row of terminals 40. Each of first ends of the two metal material sheets 911 is provided with a hook 913 locked with the base seat of the first seat 31, and each of second ends of the two metal material sheets 911 is provided with a separated section 912 exposed from the rear end of the base seat of the first seat 31. Each of the two sides of the base seat of the second seat 32 is provided with a metal material sheet 921. The two metal material sheets 921 are disposed on two outer sides of the one row of terminals 40 and are separated from the one row of terminals 40 so that the metal material sheets 921 are insulated from all of the contacts 44 of the terminals 40. The two metal material sheets 921 have first ends each provided with a hook 923 locked the base seat of the first seat 32, and second ends each provided with a separated section 922 exposed from the left and right sides of the base seat of the second seat 32.

Figure 6:
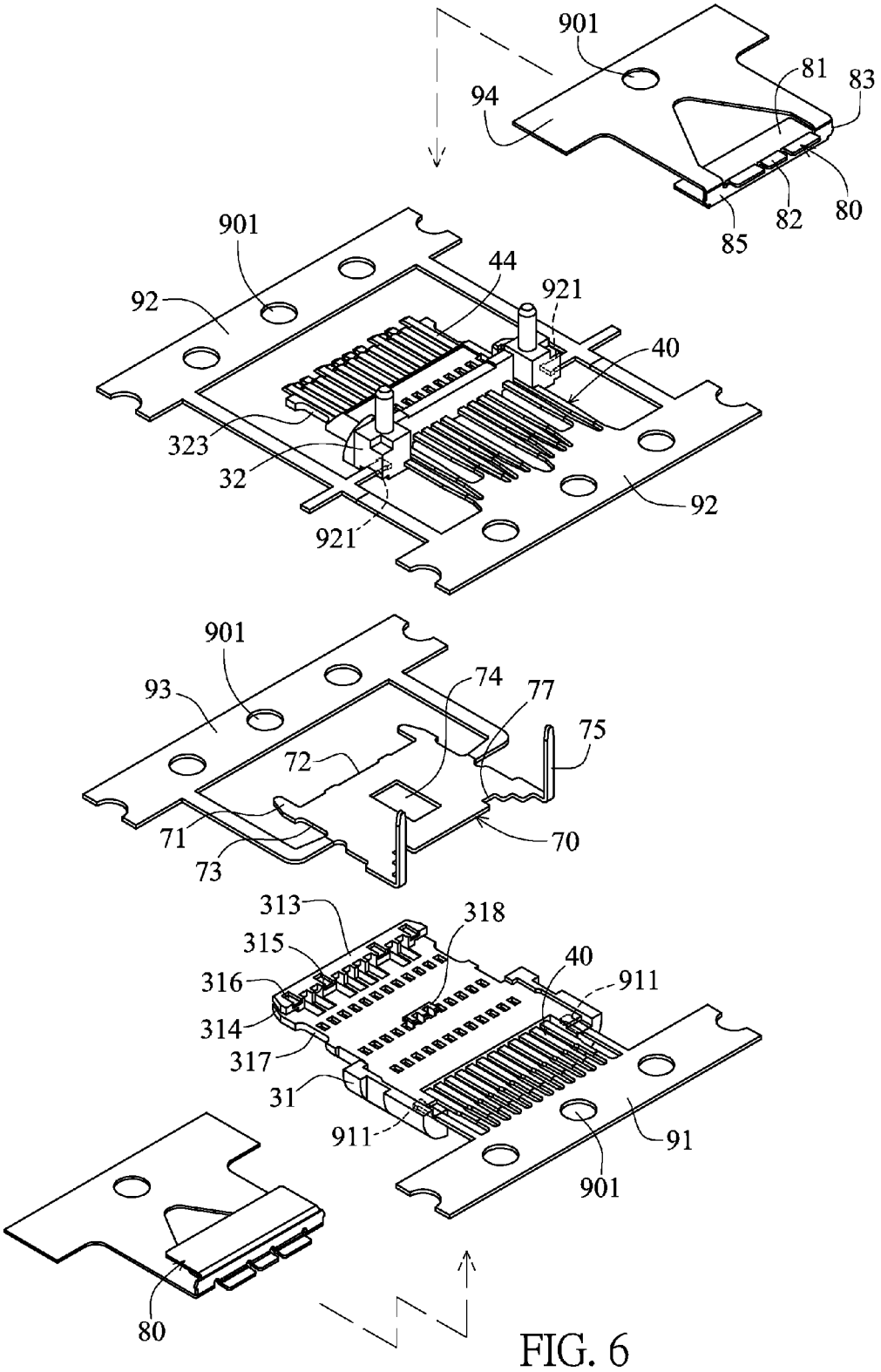
FIG. 6 is a pictorial view showing the manufacturing and assembling processes according to the first embodiment of the invention.

FIGS. 6 to 19 show the manufacturing and assembling processes of this embodiment. Referring to FIG. 6, when the terminal pressing and electroplating are finished, the one row of terminals 40 and the two metal material sheets 911 are arranged and connected to a material tape 91 and then embedded and injection molded with the first seat 31 to form the above-mentioned structure. The two metal material sheets 911 and the material tape 91 are at the same height. The one row of terminals 40 and the two metal material sheets 921 are arranged and connected to a material tape 92, and then embedded and injection molded with the second seat 31 to form the above-mentioned structure. The two metal material sheets 921 and the material tape 92 are at the same height. When the metal partition plate 70 is pressed to form the above-mentioned structure, the left and right sides are connected to a material tape 93. When the grounding sheet 80 is pressed to form the above-mentioned structure, the top ends of two sides of the vertical sheet 85 are connected to a material tape 94. The material tapes 91, 92, 93 and 94 are provided with position guiding holes 901 and can be assembled in conjunction with the automatic assembling machine. Thus, the first seat 31, the second seat 32, the metal partition plate 70 and the grounding sheet 80 can be automatically assembled using the position guiding transportation of the material tape of the automatic assembling machine.

Figures 5, 5A, 5B:
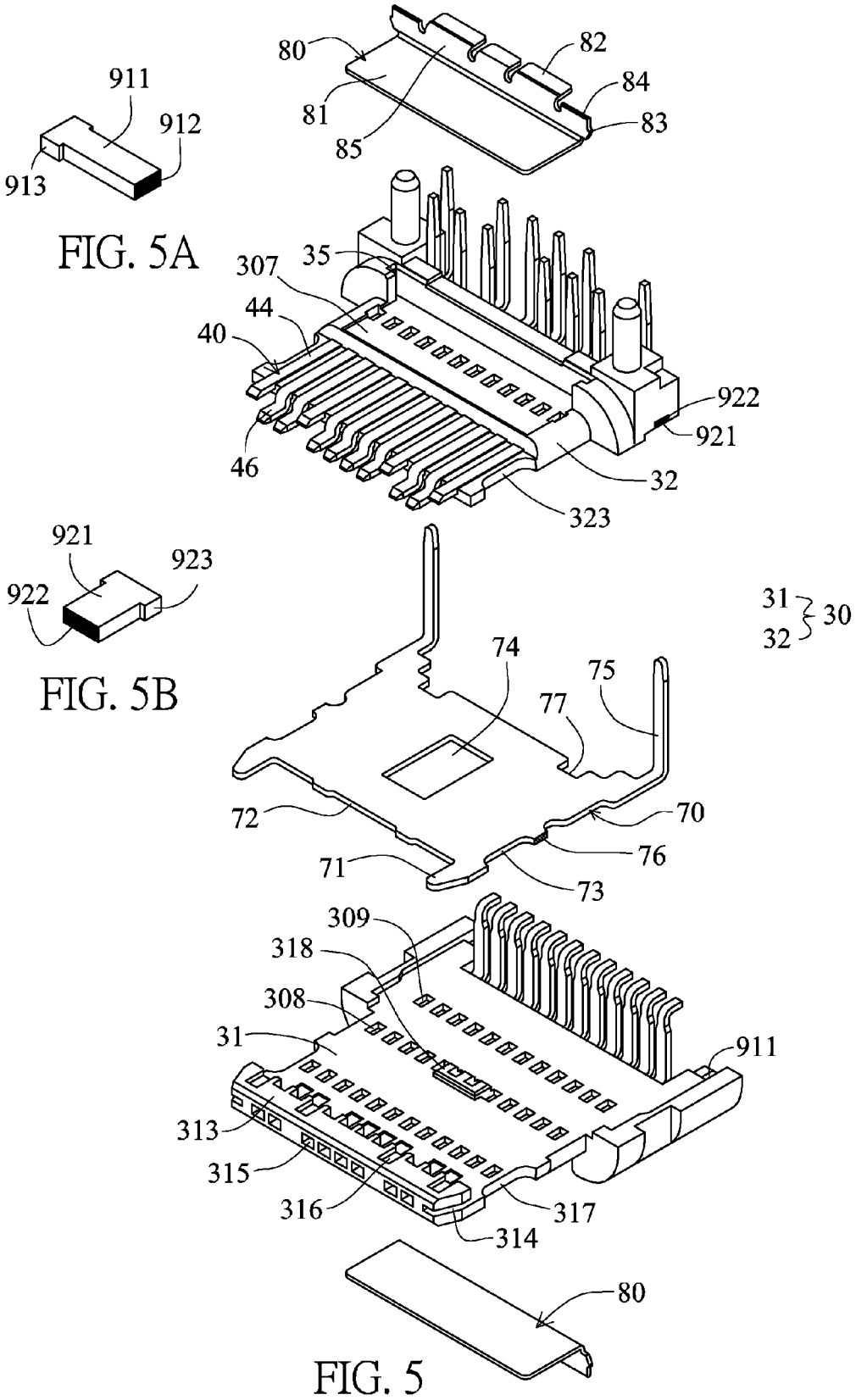
FIG. 5 is a pictorially exploded partial view according to the first embodiment of the invention.
FIG. 5A is a pictorial view showing the metal material sheet 911 according to the first embodiment of the invention.
FIG. 5B is a pictorial view showing the metal material sheet 921 according to the first embodiment of the invention.
Figure 7:
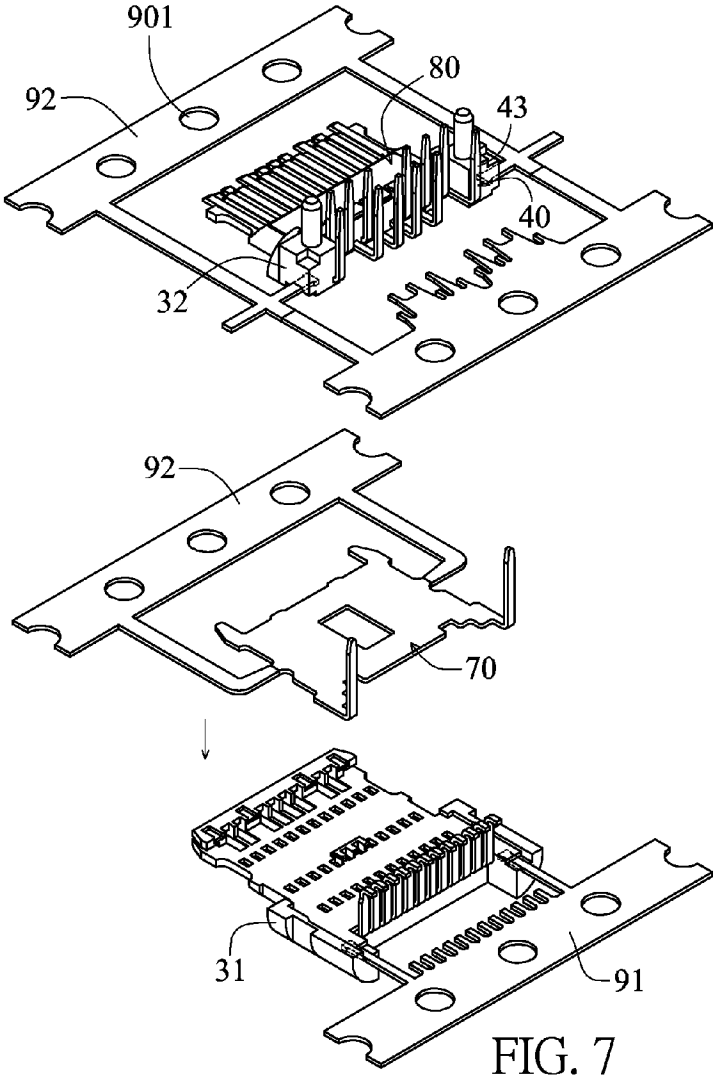
FIG. 7 is a pictorial view showing the manufacturing and assembling processes according to the first embodiment of the invention.

Referring to FIG. 7, the pins 43 of the one row of terminals 40 on the first seat 31 are bent to be vertical. At this time, although the one row of terminals 40 are separated from the material tape 91, the first seat 31 is still connected to the material tape 91 through the two metal material sheets 911. The pins 43 of the one row of terminals 40 on the second seat 32 are bent to be vertical. At this time, although the one row of terminals 40 are separated from the material tape 92, the second seat 32 is still connected to the material tape 92 through the two metal material sheets 921. After the two grounding sheets 80 are assembled with the first and second seats 31, they are separated from the material tape 94. At this time, as shown in FIG. 5, each of two sides of the top end of the vertical sheet 85 is in the form of a separated section 84.

Figure 8:
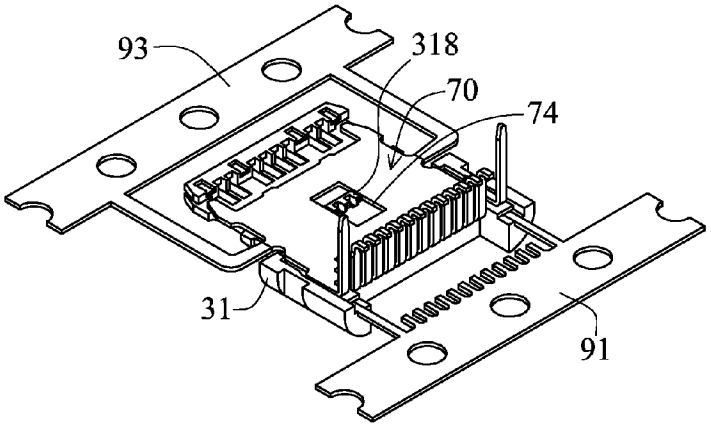
FIG. 8 is a pictorial view showing the manufacturing and assembling processes according to the first embodiment of the invention.

Referring to FIG. 8, the metal partition plate 70 is then assembled with the jointing surface of the first seat 31, and the opening 74 engages with the projection 318.

Figure 9:
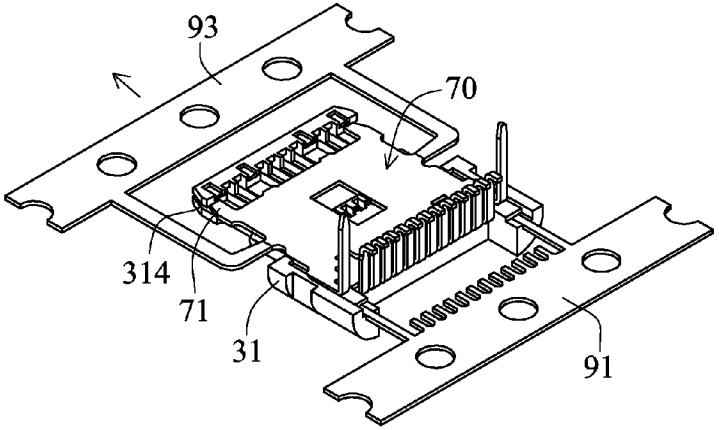
FIG. 9 is a pictorial view showing the manufacturing and assembling processes according to the first embodiment of the invention.

Referring to FIG. 9, the material tape 93 is then moved frontwards to make the engaging plate 71 of the metal partition plate 70 partially engage into the slot 314.

Figure 10:
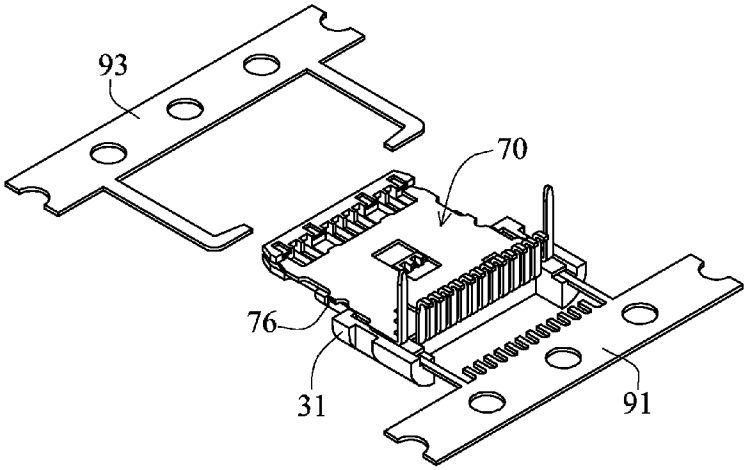
FIG. 10 is a pictorial view showing the manufacturing and assembling processes according to the first embodiment of the invention.

Referring to FIG. 10, the material tape 93 is then separated from the metal partition plate 70, so that each of left and right sides of the metal partition plate 70 is in the form of a separated section 76.

Figure 11:
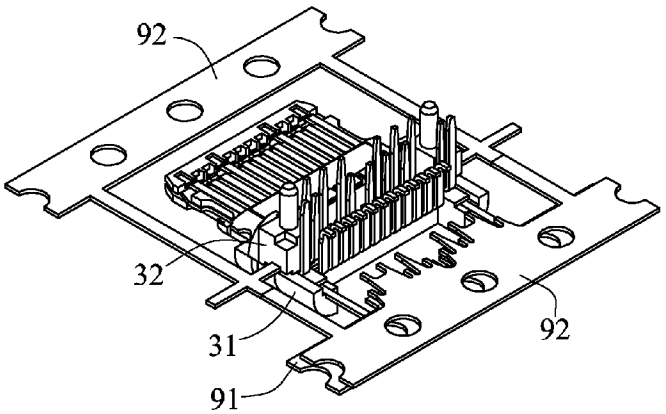
FIG. 11 is a pictorial view showing the manufacturing and assembling processes according to the first embodiment of the invention.

Referring to FIG. 11, the jointing surface of the second seat 32 is then placed on the jointing surface of the first seat 31 to surround the metal partition plate 70, and the second seat 31 engages with the notch 77 of the rear end of the metal partition plate 70.

Figure 12:
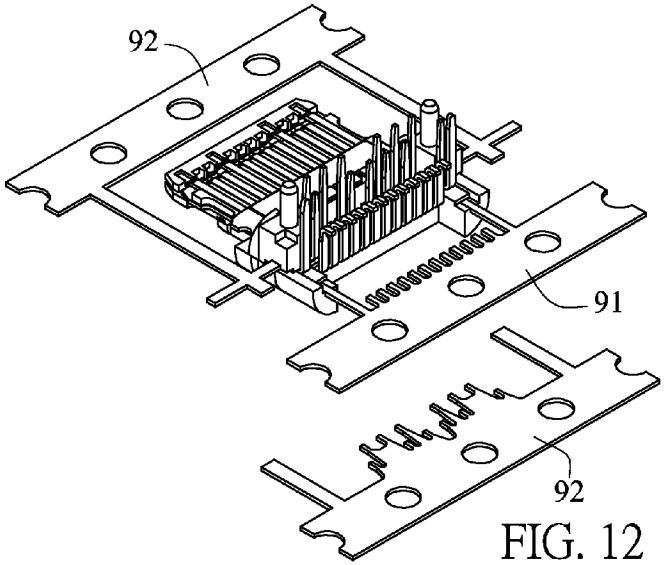
FIG. 12 is a pictorial view showing the manufacturing and assembling processes according to the first embodiment of the invention.

Referring to FIG. 12, the portion of the material tape 92 disposed in back of the second seat 32 is separated.

Figure 13:
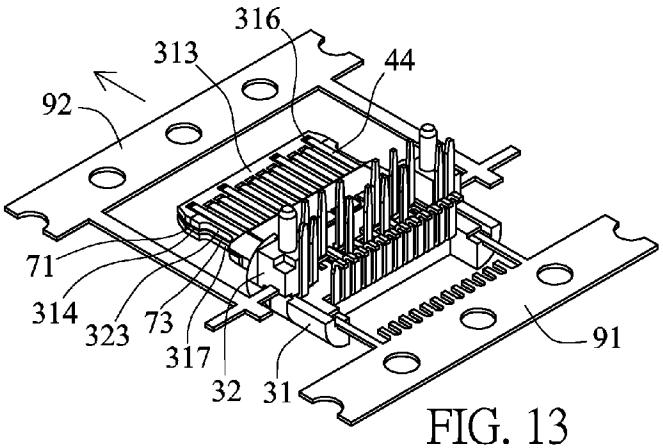
FIG. 13 is a pictorial view showing the manufacturing and assembling processes according to the first embodiment of the invention.

Referring to FIG. 13, the material tape 92 is then moved frontwards so that the second seat 32 is moved frontwards to finish the combination of the first seat 31, the metal partition plate 70 and the second seat 32. At this time, the engaging plate 71 of the metal partition plate 70 fully engages into the slot 314, the engaging projections 46 of the terminal 40 of the eight shorter contacts of the second seat 32 engage into the slots 315 of the first seat 31, the front ends of the terminal 40 of the four longer contacts are connected to the space providing slots 316, the front edge of the jointing portion of the second seat 32 is connected and flush with the convex surface 316, and the notches 317 and 323 of the first and second seats 31 and 32 are aligned with the slots 73 of the metal partition plate 70.

Figure 14:
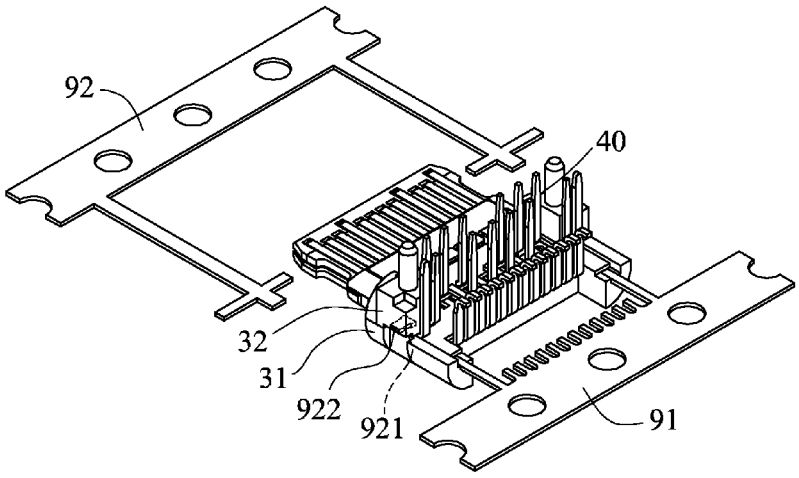
FIG. 14 is a pictorial view showing the manufacturing and assembling processes according to the first embodiment of the invention.

Referring to FIG. 14, the material tape 92 is then cut along the edge of the second seat 32 so that the material tape 92 is separated from the second seat 32. At this time, the two metal material sheets 921 are disposed on two outer sides of the one row of terminals 40 and are separated from the one row of terminals 40, and the two metal material sheets 921 are formed with separated sections 922 exposed from the left and right sides of the base seat of the second seat 32.

Figure 15:
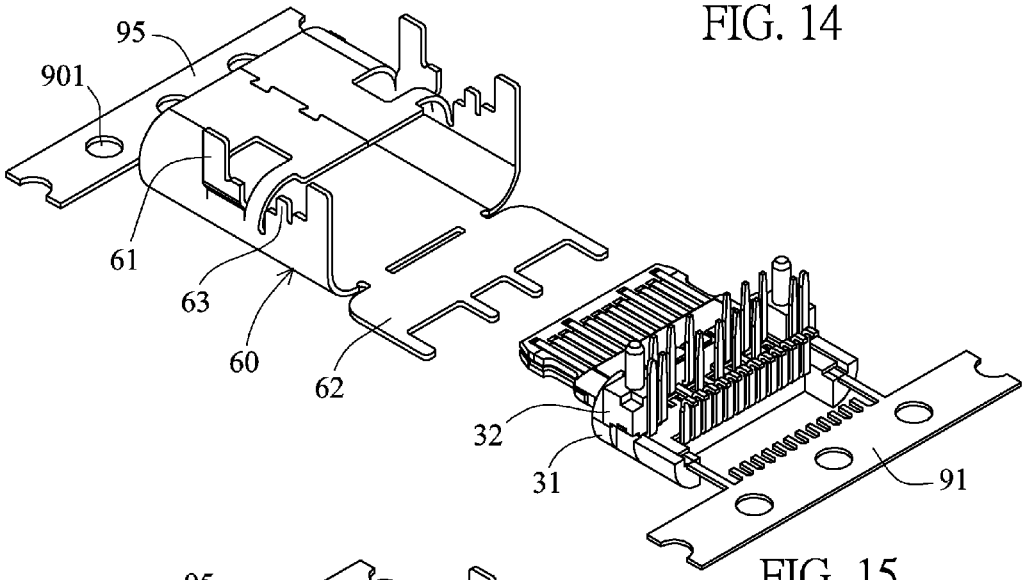
FIG. 15 is a pictorial view showing the manufacturing and assembling processes according to the first embodiment of the invention.

Referring to FIG. 15, the metal housing 60 is then prepared to be assembled, wherein the front end of the pressed metal housing 60 is connected to a material tape 95.

Figure 16:
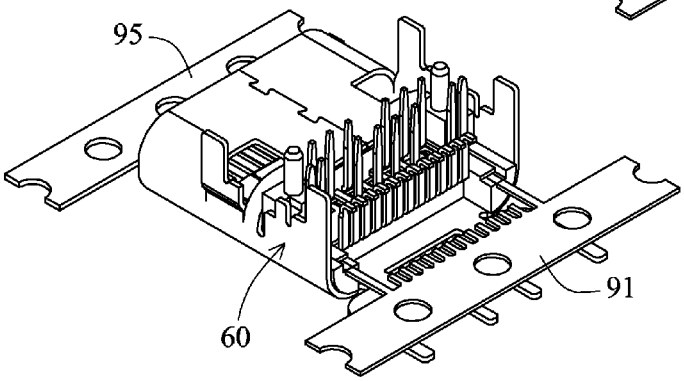
FIG. 16 is a pictorial view showing the manufacturing and assembling processes according to the first embodiment of the invention.

Referring to FIG. 16, the metal housing 60 is assembled to fit with the first and second seats 31 and 32.

Figure 17:
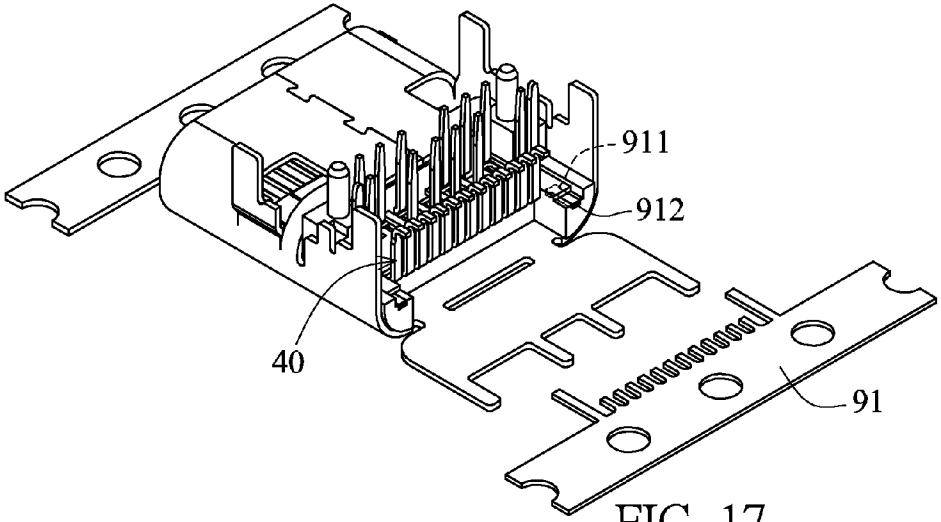
FIG. 17 is a pictorial view showing the manufacturing and assembling processes according to the first embodiment of the invention.

Referring to FIG. 17, the material tape 91 is then cut along the edge of the first seat 31 so that the material tape 91 is separated from the first seat 31. At this time, the two metal material sheets 911 are disposed on two outer sides of the one row of terminals 40 and are separated from the one row of terminals 40, and each of the two metal material sheets 911 is formed with a separated section 912 exposed from the rear end of the base seat of the first seat.

Figure 18:
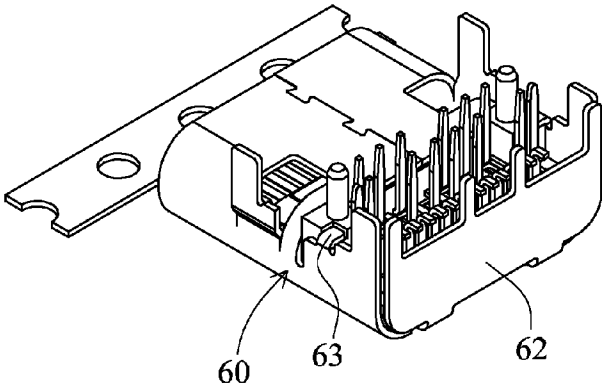
FIG. 18 is a pictorial view showing the manufacturing and assembling processes according to the first embodiment of the invention.

Referring to FIG. 18, the rear plate 62 of the metal housing 60 is then bent to be vertically disposed in back of the insulated seat 30, and the locking sheet 63 is bent and locked into bottom ends of the left and right sides of the insulated seat 30.

Figure 4:
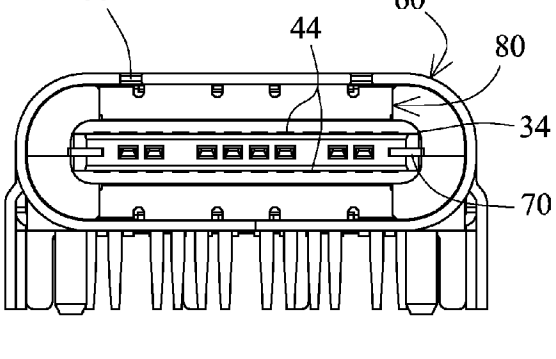
FIG. 4 is a front view according to the first embodiment of the invention.
Figure 3:
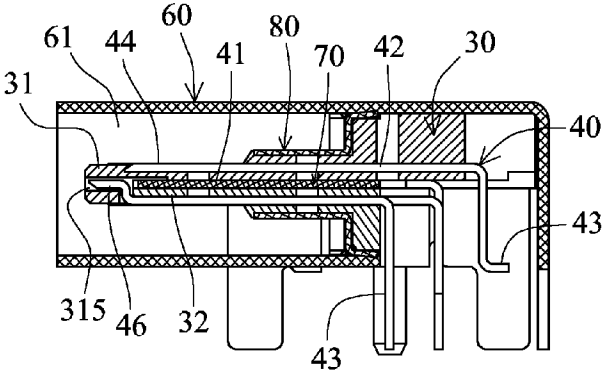
FIG. 3 is a side cross-sectional view according to the first embodiment of the invention.
Figure 19:
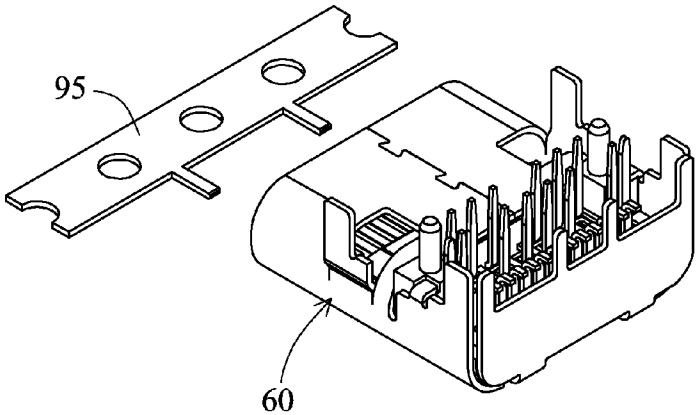
FIG. 19 is a pictorial view showing the manufacturing and assembling processes according to the first embodiment of the invention.

Referring to FIG. 19, the material tape 95 and the metal housing 60 are finally separated from each other, and the front end of the metal housing 60 is in the form of two separated sections 68, as shown in FIG. 4.

It is obtained, from the above-mentioned description, that in the manufacturing and assembling processes of this embodiment, the first seat 31, the second seat 32, the metal partition plate 70, the grounding sheet 80 and the metal housing 60 may utilize the position guiding transportation of the material tape of the automatic assembling machine to achieve the automatic assembly, save the artificial cost and enhance the efficiency and yield, wherein the advantages can be generalized as follows.

1. The insulated seat can be connected to a material tape through at least two metal material sheets to achieve the convenience of the manufacturing and assembling processes.

2. The insulated seat can be connected to a material tape through at least one metal material sheet to achieve the convenience of the manufacturing and assembling processes.

3. The invention is convenient to a small variety of manual jig products to be assembled or a lot of automatic assembly requirements.

4. The invention is convenient to the switching requirements of the metal terminals to be machined by a small variety of specifications and models of pressing molds.

5. The invention is convenient to the precise dimension requirements in a small variety of switching of metal terminals or a lot of pressing machining of metal terminals.

6. The invention is convenient to the strain avoiding and abnormal requirements of the stable electroplating of metal terminals.

7. The invention is convenient to the strain avoiding and abnormal requirements of the stable injection molding processing of metal terminals.

Figure 19A:
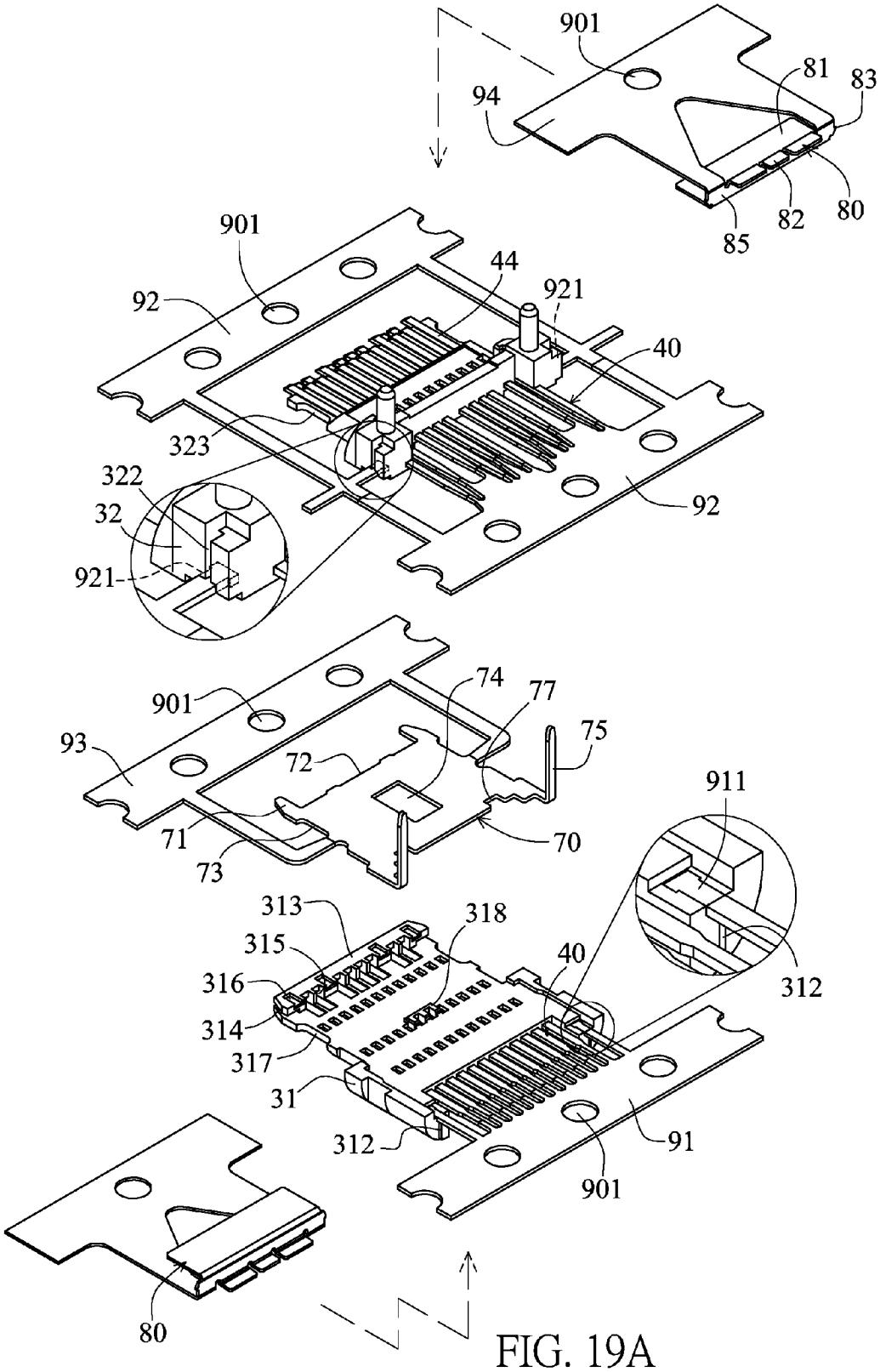
FIG. 19A is a pictorial view showing another implementary manufacturing and assembling process according to the first embodiment of the invention.
Figure 19C:
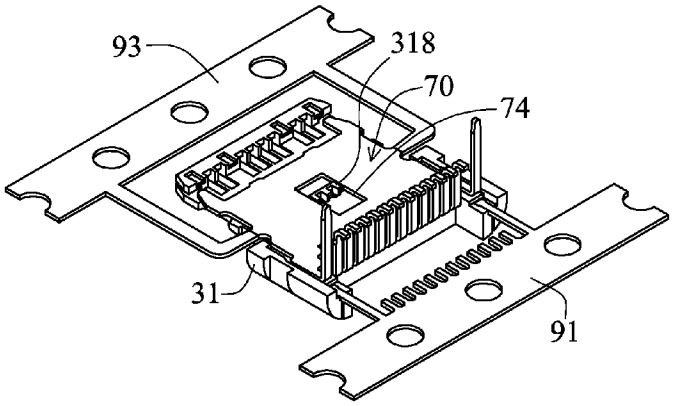
FIG. 19C is a pictorial view showing another implementary manufacturing and assembling process according to the first embodiment of the invention.
Figure 19D:
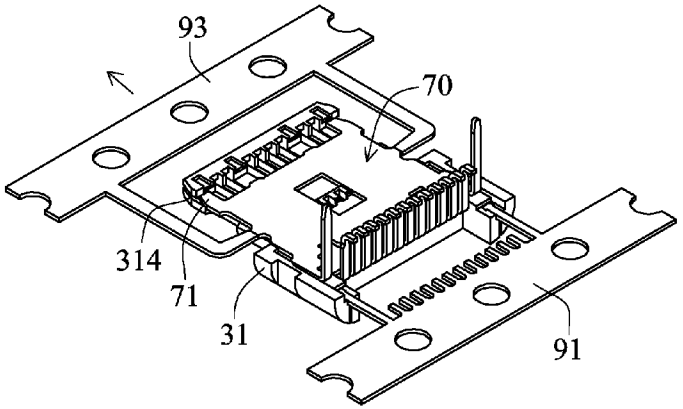
FIG. 19D is a pictorial view showing another implementary manufacturing and assembling process according to the first embodiment of the invention.
Figure 19B:
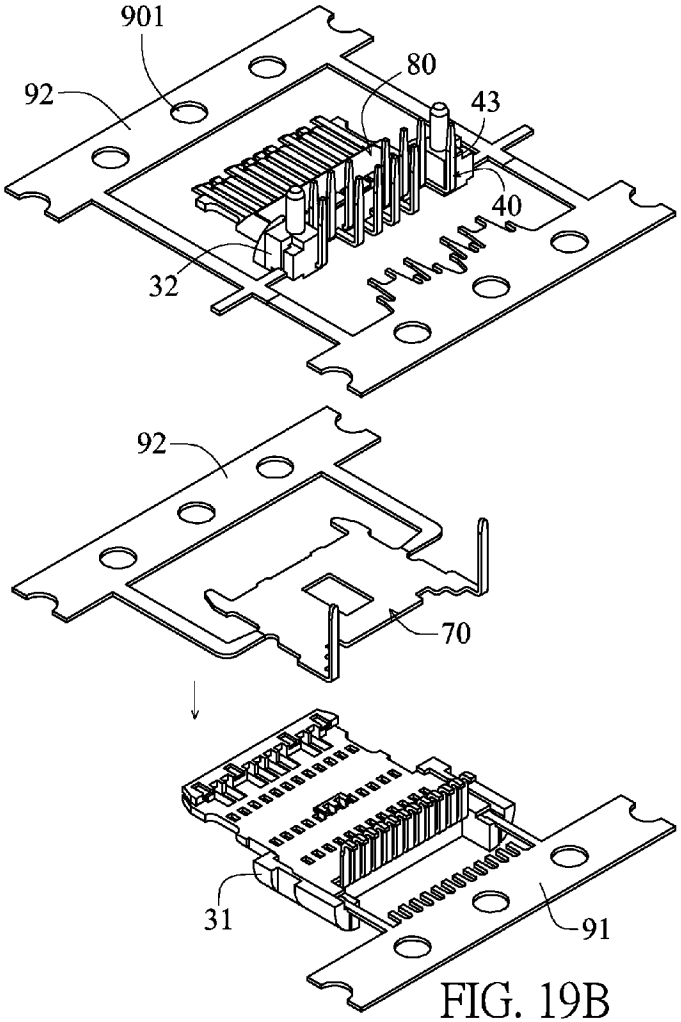
FIG. 19B is a pictorial view showing another implementary manufacturing and assembling process according to the first embodiment of the invention.
Figure 19G:
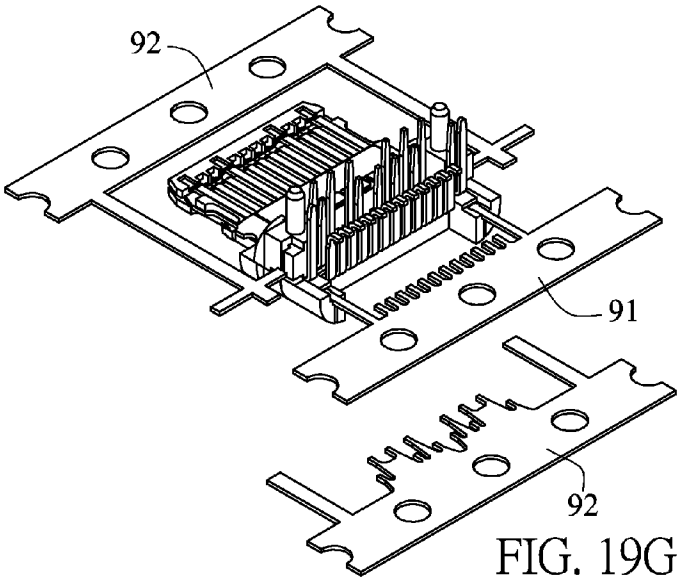
FIG. 19G is a pictorial view showing another implementary manufacturing and assembling process according to the first embodiment of the invention.
Figure 19H:
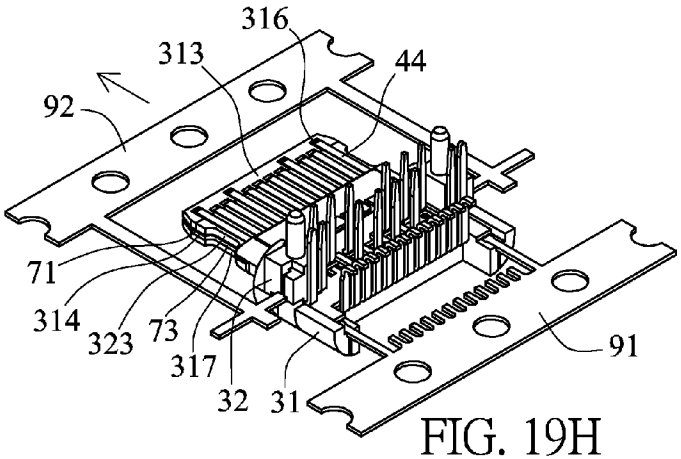
FIG. 19H is a pictorial view showing another implementary manufacturing and assembling process according to the first embodiment of the invention.
Figure 19E:
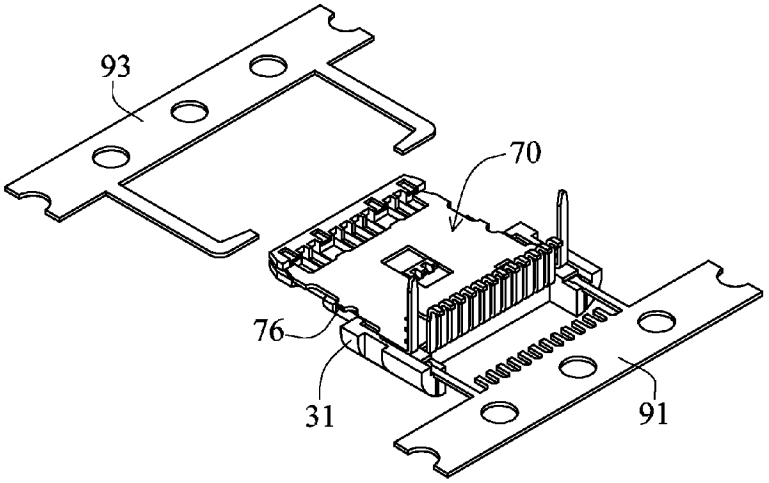
FIG. 19E is a pictorial view showing another implementary manufacturing and assembling process according to the first embodiment of the invention.
Figure 19F:
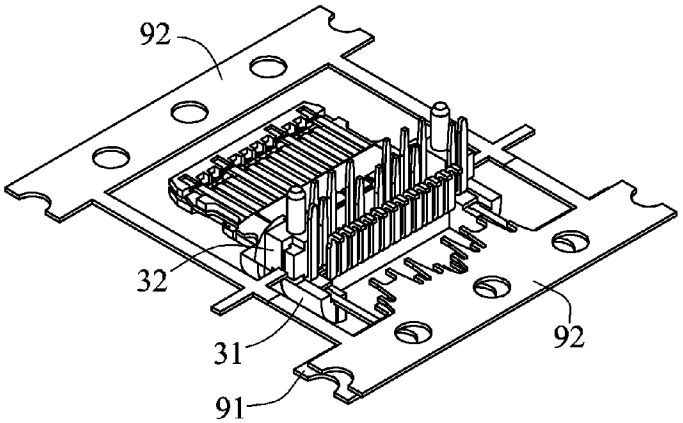
FIG. 19F is a pictorial view showing another implementary manufacturing and assembling process according to the first embodiment of the invention.
Figure 19I:
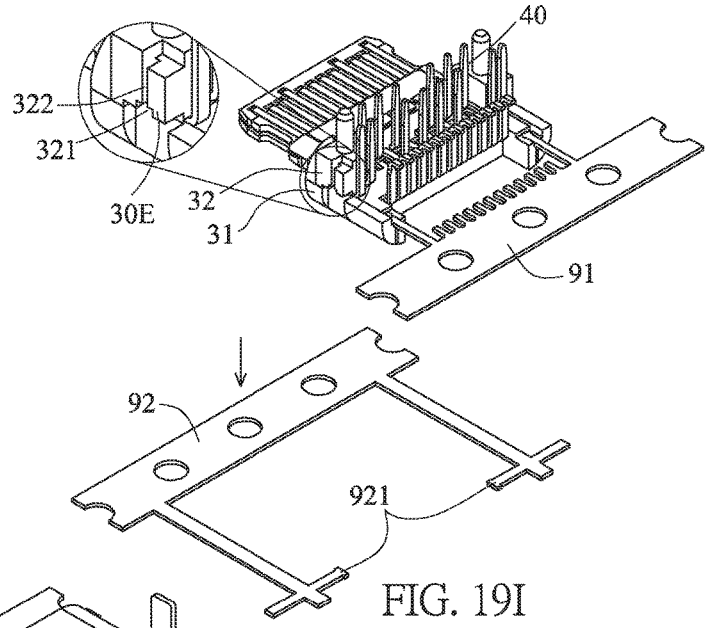
FIG. 19I is a pictorial view showing another implementary manufacturing and assembling process according to the first embodiment of the invention.
Figure 19J:
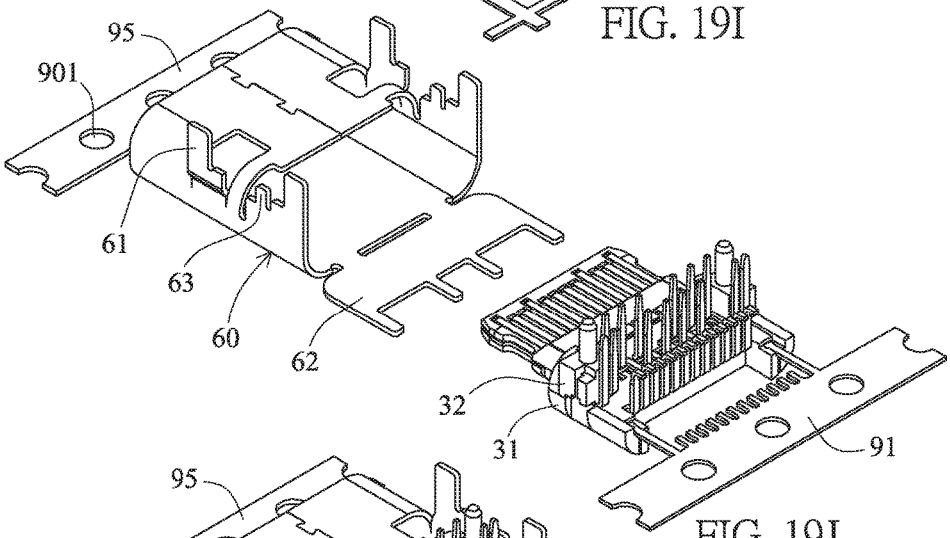
FIG. 19J is a pictorial view showing another implementary manufacturing and assembling process according to the first embodiment of the invention.
Figure 19K:
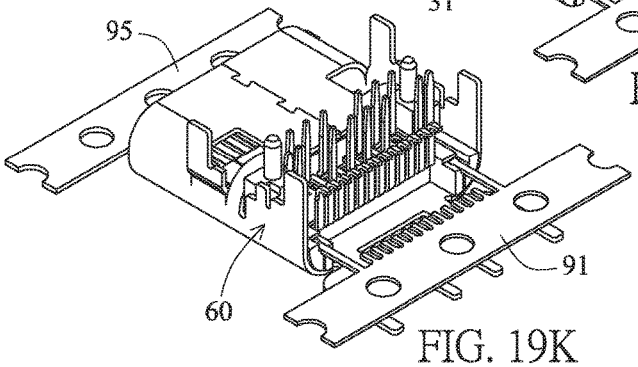
FIG. 19K is a pictorial view showing another implementary manufacturing and assembling process according to the first embodiment of the invention.
Figure 19M:
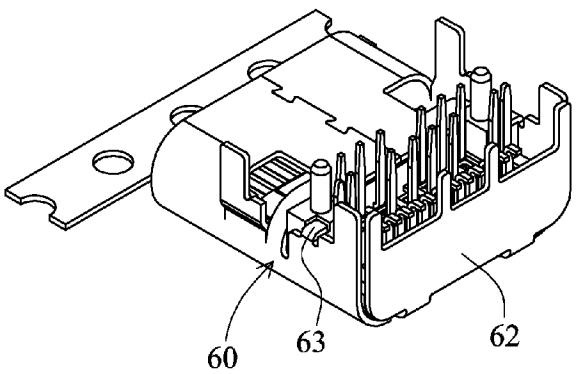
FIG. 19M is a pictorial view showing another implementary manufacturing and assembling process according to the first embodiment of the invention.
Figure 19N:
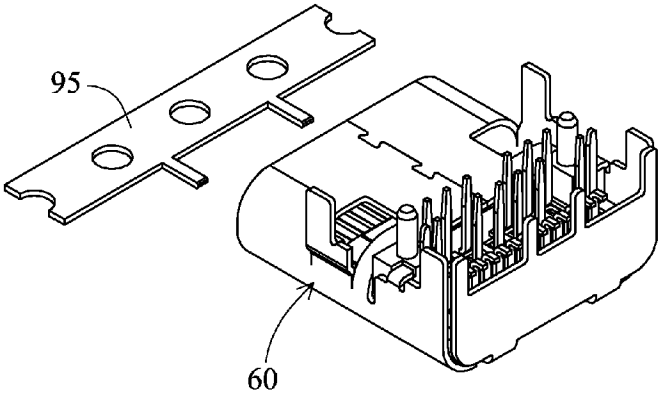
FIG. 19N is a pictorial view showing another implementary manufacturing and assembling process according to the first embodiment of the invention.

Referring to FIGS. 19A to 19N of another implementation state of this embodiment, the manufacturing and assembling processes are substantially the same as those of FIGS. 6 to 19, except for the difference shown in FIG. 19A, wherein the first and second seats 31 and 32 are reversely placed and assembled in the top-bottom direction. When the pressing and electroplating of the top and bottom terminals are finished, the one row of terminals 40 and the two metal material sheets 911 are arranged and connected to a material tape 91 and then embedded and injection molded with the first seat 31, wherein the two metal material sheets 911 are embedded into the left and right sides of the rear end of the first seat 31, the front, left, right and top surfaces of the metal material sheet 911 are embedded into and fixed to the first seat 31, and only the bottom surface is open and not embedded. The top surface of the first seat 31 is provided with a vertical-direction through hole 312 communicating with the bottom surface of the metal material sheet 911. The through hole 312 is narrower than the metal material sheet 911 and penetrates through the rear end of the first seat 31. The other one row of terminals 40 and the two metal material sheets 921 are arranged and connected to a material tape 92, and then embedded and injection molded with the second seat 32, wherein the two metal material sheets 921 are embedded into left and right sides of the second seat 32, four surfaces of the metal material sheet 921 are embedded into and fixed to the second seat 32, and only the top surface is open and not embedded. The bottom surface of the second seat 32 is provided with a vertical-direction through hole 322 communicating with the bottom surface of the metal material sheet 921, and the width of the through hole 322 is narrower than the metal material sheet 921 and penetrates through the left or right side of the second seat 31.

As shown in FIG. 19I, the jig stretches into the through hole 322 and exerts a force in the vertical direction to push out the two metal material sheets 921, to separate the material tape 92 from the second seat 32. At this time, the two metal material sheets 921 are detached from the second seat 32, and the left and right sides of the base seat of the second seat 32 are formed with vertically depressed slots 321 disposed on two outer sides of the one row of terminals 40, wherein the tops of the two slots 321 are open to the outside and the left and right side edges 30E of the second seat 32 are open to the outside. The through hole 322 penetrates from the bottom surface of the second seat 32 to the slot 321. So, as shown in FIGS. 19A to 19I, the material tape 92 before being fixed to the insulated seat (the combination of 31 and 32) is provided with at least one metal material sheet 921, and after the material tape 92 is connected to the insulated seat, the insulated seat is separated from the at least one metal material sheet 921 to form at least one slot 321.

Figure 19L:
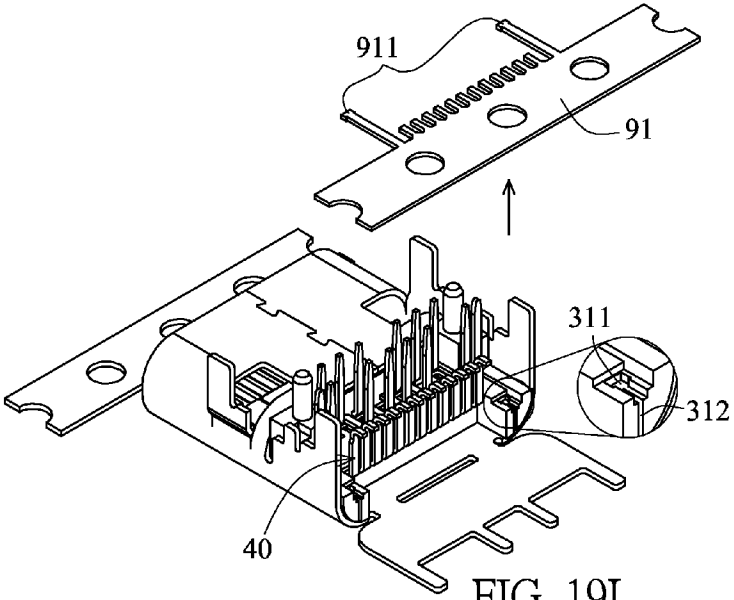
FIG. 19L is a pictorial view showing another implementary manufacturing and assembling process according to the first embodiment of the invention.

As shown in FIG. 19L, the jig stretches into the through hole 312 and exerts a force in the vertical direction to push out the two metal material sheets 911, to separate the material tape 91 from the first seat 31. At this time, the two metal material sheets 911 are detached from the first seat 31, and the left and right sides of the rear end of the base seat of the first seat 31 are formed with vertically depressed slots 311 disposed on two outer sides of the one row of terminals 40. The bottoms of the two slots 311 are open to the outside and the rear end edge of the second seat 31 is open to the outside. The through hole 312 penetrates from the top surface of the first seat 31 to the slot 311.

Figure 19O:
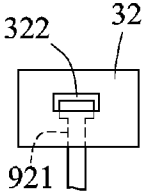
FIG. 19O is a top view showing still another implementary manufacturing and assembling processes according to the first embodiment of the invention.
Figure 19P:
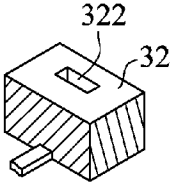
FIG. 19P is a pictorial view showing still another implementary manufacturing and assembling processes according to the first embodiment of the invention.
Figure 19Q:
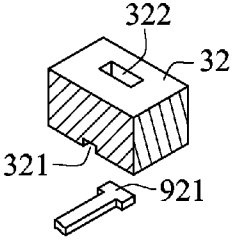
FIG. 19Q is a pictorial view showing still another implementary manufacturing and assembling processes according to the first embodiment of the invention.

Referring to FIGS. 19O to 19Q, the through hole 322 of the embodiment's second seat 31 may also be designed to be wider than the metal material sheet 921, but only vertically communicate with the inner end of the metal material sheet 921 without penetrating through the left or right side of the second seat 31. Thus, the jig stretches into the through hole 322 and exerts a force from the side edge of the second seat 31 onto two points to push away the metal material sheet 921, wherein the implementation of the through hole 312 of the first seat 31 is also the same.

Figure 22:
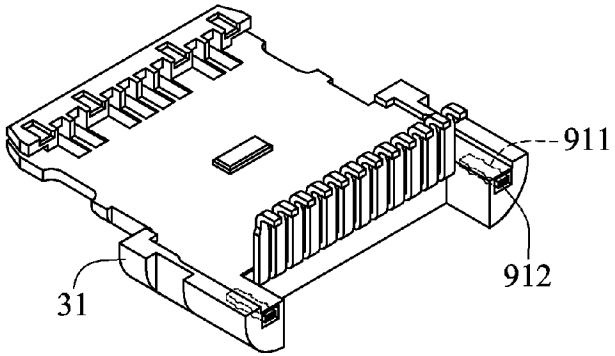
FIG. 22 is a pictorially assembled partial view according to the second embodiment of the invention.
Figure 20:
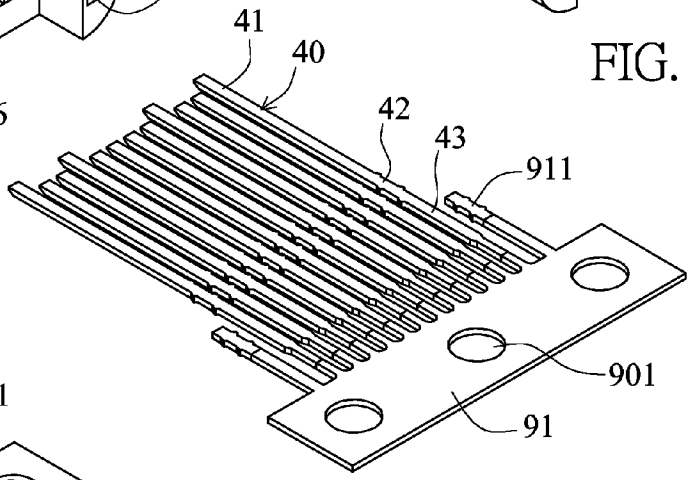
FIG. 20 is a pictorially exploded partial view according to the second embodiment of the invention.
Figure 21:
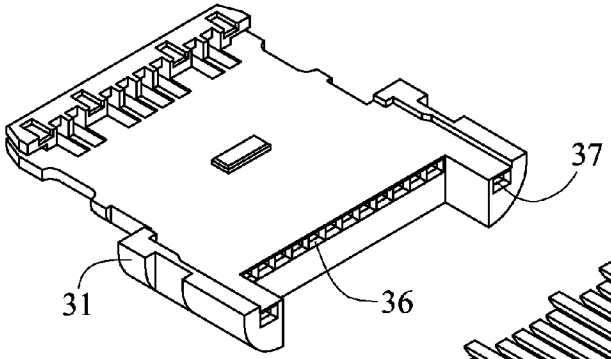
FIG. 21 is a pictorially assembled partial view according to the second embodiment of the invention.
Figure 21:
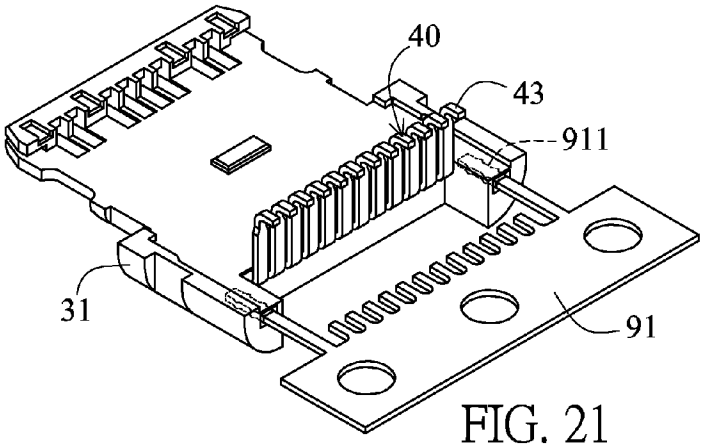

Referring to FIGS. 20 to 22, the second embodiment of the invention is substantially the same as the first embodiment except for the difference that the first seat 31 of this embodiment is provided with one row of terminal slots 36 and two metal material sheet slots 37. Referring to FIG. 21, the one row of terminals 40 and the two metal material sheets 911 are arranged and connected to the material tape 91 and assembled with the one row of terminal slots 36 and the two metal material sheet slots 37, and then the pins 43 of the one row of terminals 40 are separated from the material tape 91 and bent. At this time, the first seat 31 is still connected to the material tape 91 through the two metal material sheets 911. Referring to FIG. 22, after the two metal material sheets 911 are separated from the material tape 91, each of the two metal material sheets 911 is formed with a separated section 912 exposed from the rear end of the base seat of the first seat 31.

Referring to FIGS. 23 to 26, the third embodiment of the invention is a C-TYPE USB electrical connection plug comprising an insulated seat 30, two rows of terminals 40, a metal housing 60, a metal partition plate 70 and two grounding sheets 80.

The insulated seat 30 is made of a plastic material and comprises a base seat and a jointing portion 38. The base seat is provided with a first seat 31 and a second seat 32 vertically stacked. Each of the outer surfaces of the first and second seats 31 and 32 is provided with a concave surface 301, ad each of the jointing surfaces thereof is provided with a concave surface 302. The front ends of both of them are provided with fitting portions 303 connected together, and two sides of both of them are provided with locking portions 304 for upward limiting and downward limiting, respectively. The jointing portion 38 is in the form of a fitting frame body, and has top-bottom symmetrical and left-right symmetrical inner and outer shapes and has two arced sides, wherein the rear end thereof is provided with a fitting portion 381 fitting with the fitting portion 303 of the base seat, and each of the upper and lower portions thereof is an insulating substrate 382. The middle and rear sections of the two insulating substrates 382 are in the form of one row of separated separation columns to form separated slots. The opposite surfaces of the two insulating substrates 382 are two connection surfaces 383 between which a connection slot 384 is formed. Each of the top and bottom surfaces outside the jointing portion 38 is provided with a concave surface 385, each of the front sections thereof is provided with three openings 386 communicating with the connection slot 384, the front end thereof is provided with a projecting ring 387, and each of two sides thereof is provided with a longitudinal opening 388 extending from the rear end to the front section. The front section of the connection slot 384 is higher than the rear section thereof. The connection slot 384 and the jointing portion 38 may dock with an electrical connector in a dual-position bidirectional manner.

The two rows of terminals 40 are embedded and injection molded with the first and second seats 31 and 32, respectively. The terminal 40 is integrally pressed and bent to provide an extension 41, a fixing portion 42 and a pin 43. The fixing portion 42 is fixed to the base seat. The extension 43 is connected to the front end of the fixing portion 42 and extends out of the separated slots of the insulating substrate 382 of the jointing portion 38 in front of the base seat. The extension 43 is a straight elastic arm and is vertically elastically movable, and has a front section bent reversely to form a projecting contact 44, wherein the reversely bent section is shorter and elastically non-movable. The contact 44 projects from the connection surface 383 to the connection slot 384. The contacts 44 of the two rows of terminals 40 project beyond two connection surfaces of the jointing portion 38 and are vertically aligned. The contacts 44 of the two rows of terminals 40 have the same contact interface, and the contact interfaces have connection points with circuit serial numbers arranged reversely.

The metal partition plate 70 is assembled with the concave surface 302 of the jointing surface of the first and second seats 31 and 32 and is positioned between the upper and lower seats 31 and 32. The rear end of the metal partition plate 70 is integrally provided with two pins 75 and the left and right sides of the metal partition plate 70 are integrally provided with resilient snaps 710. The resilient snaps are provided with projections 711 disposed on the left and right sides of the connection slot 384. The two resilient snaps 711 contact the metal housing 60 and stretch into the connection slot 384 from the openings 388 on the left and right sides of the jointing portion 38. The two pins 75 extend out of the insulated seat 30.

The two grounding sheets 80 are assembled and locked with the concave surfaces 301 of the outer surfaces of the upper and lower seats 31 and 32 and the concave surfaces 385 of the top and bottom surfaces of the jointing portion 38, respectively. The grounding sheet 80 is in the form of a plate sheet, and has a front section provided with a large opening to form two elastic arms 89, a rear section provided with a projecting elastic sheet 87 resiliently resting against the metal housing 60, a front end bent to form three projecting contacts 86, and a rear section with two sides each bent to projectingly provide an engaging portion 88. The projecting directions of the engaging portion 88 and the contact 86 are reverse to that of the elastic sheet 87. The engaging portions 88 of the two grounding terminals 80 engage with the locking portions 304 of the first and second seats 31 and 32 to provide the upward limiting and downward limiting functions, respectively. The contacts 86 of the two grounding terminals 80 pass through the three openings 386 of the top and bottom surfaces of the jointing portion 38 and project beyond the front sections of the two connection surfaces 83 to be disposed in the connection slot 84. The contact 44 of the terminal 40 is more convex toward the connection slot 84 than the contact 86 of the grounding sheet 80.

The metal housing 60 covers the insulated seat 30. The metal housing 60 has a front view shape, which also approaches a rectangle and is top-bottom-left-right symmetrical, and two arced sides. The metal housing 60, after being fit with the rear end of the insulated seat 30, is stopped by and flush with the projecting ring 387 of the jointing portion 38.

Figure 31A:
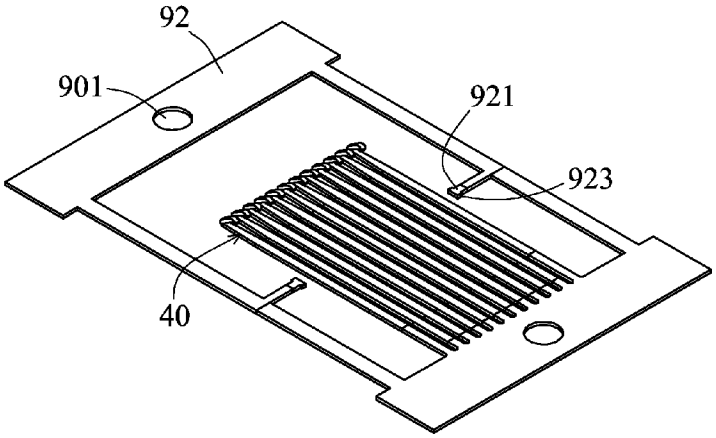
FIG. 31A is a pictorial view showing the manufacturing and assembling processes according to the third embodiment of the invention.

This embodiment is characterized in that the two sides of the first seat 31 are provided with a metal material sheet 911. The two metal material sheets 911 are disposed on two outer sides of the one row of terminals 40 and are separated from the one row of terminals 40. The two metal material sheets 911 have first ends each provided with a hook 913 (see FIG. 27) locking in the first seat 31, and second ends each provided with a separated section 912 exposed from the rear end of the first seat 31. Each of the two sides of the base seat of the second seat 32 is provided with a metal material sheet 921. The two metal material sheets 921 are disposed on two outer sides of the one row of terminals 40 and are separated from the one row of terminals 40. The two metal material sheets 921 have first ends each provided with a hook 923 (see FIG. 31A) locking in the base seat of the first seat 32, and second ends each provided with a separated section 922 exposed from the left and right sides of the base seat of the second seat 32.

FIG. 27 to FIG. 41 show the manufacturing processes of this embodiment.

Figure 27:
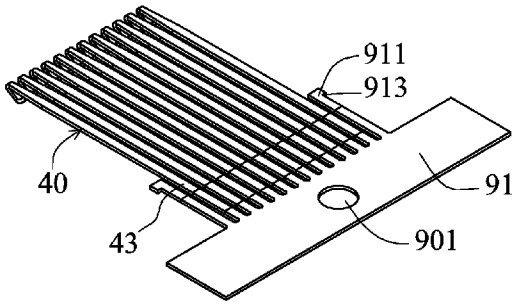
FIG. 27 is a pictorial view showing the manufacturing and assembling processes according to the third embodiment of the invention.
Figure 28:
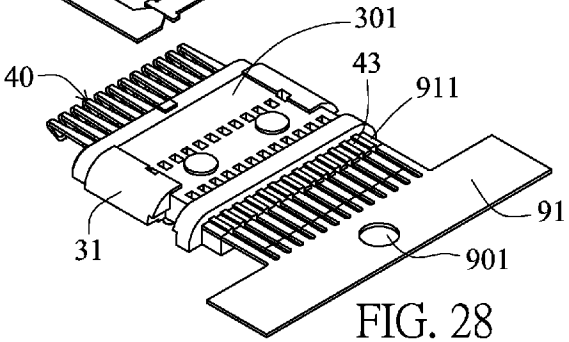
FIG. 28 is a pictorial view showing the manufacturing and assembling processes according to the third embodiment of the invention.

Referring to FIGS. 27 and 28, when the terminal pressing and electroplating are finished, the one row of terminals 40 and the two metal material sheets 911 are arranged and connected to a material tape 91 (see FIG. 27) and then embedded and injection molded with the first seat 31 to form the above-mentioned structure. When the grounding sheet 80 is pressed to form the above-mentioned structure, the engaging portion 88 is connected to a material tape 94, each of the material tapes of the manufacturing processes is provided with a position guiding hole 901 and can work in conjunction with the position guiding transportation of the automatic assembling machine to achieve the automatic operation.

Figure 29:
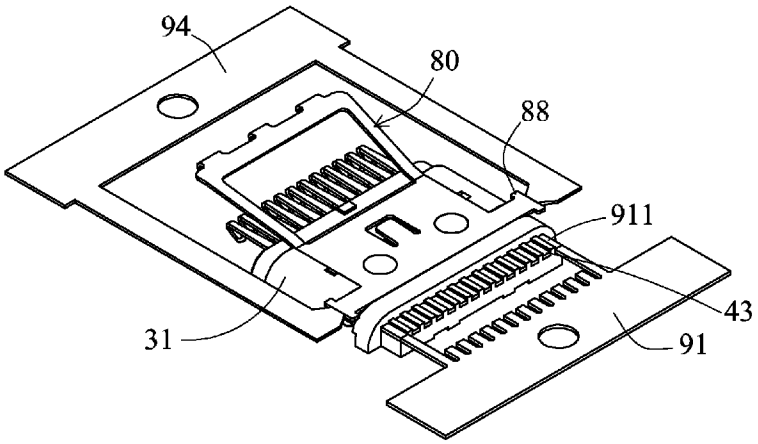
FIG. 29 is a pictorial view showing the manufacturing and assembling processes according to the third embodiment of the invention.

Referring to FIG. 29, the pins 43 of the one row of terminals 40 on the first seat 31 are cut and thus separated from the material tape 91. At this time, the first seat 31 is still connected to the material tape 91 through the two metal material sheets 911. The grounding sheet 80 is assembled with the concave surface 301 of the first seat 31.

Figure 30:
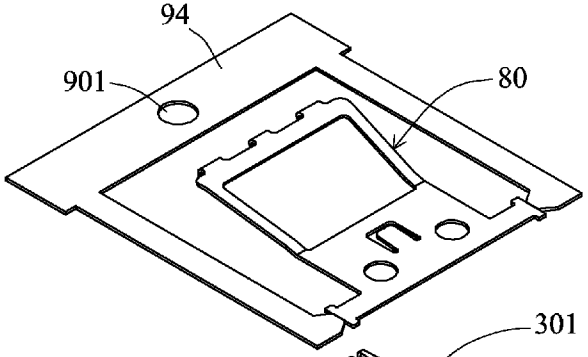
FIG. 30 is a pictorial view showing the manufacturing and assembling processes according to the third embodiment of the invention.
Figure 30:
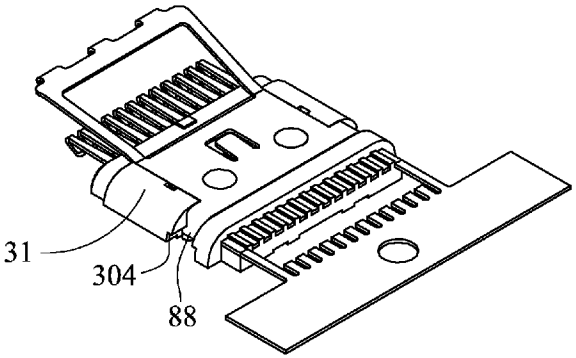

Referring to FIG. 30, after the grounding sheet 80 is separated from the material tape 94, the engaging portion 88 is bent and locked in the locking portion 304 of the bottom end of the first seat 31, wherein each of the bottom ends of the two engaging portions 88 is in the form of a separated section, so that the first seat 31 is combined with one row of terminals 40 and a grounding sheet 80.

Figure 31:
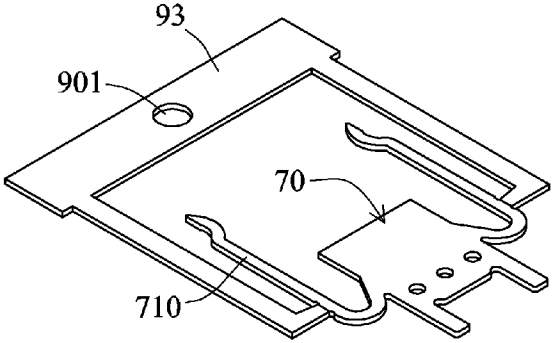
FIG. 31 is a pictorial view showing the manufacturing and assembling processes according to the third embodiment of the invention.
Figure 31:
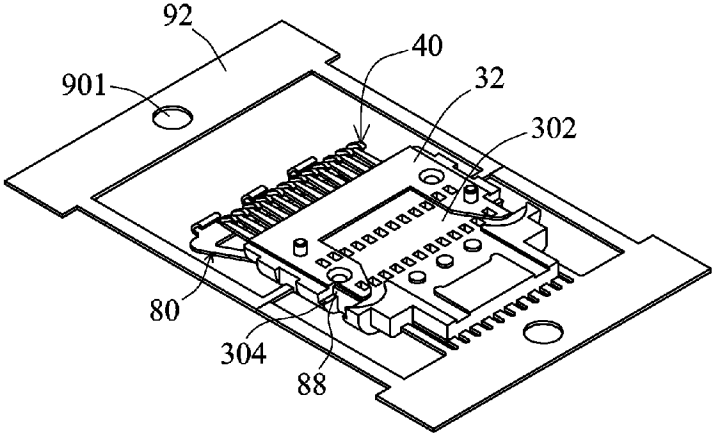

Referring to FIG. 31, the manufacturing method of the second seat 32 combined with one row of terminals 40 and a grounding sheet 80 is substantially the same as that shown in FIGS. 27 to 30, wherein the second seat 32 is connected to the material tape 92 through the two metal material sheets 921. At this time, the metal partition plate 70 is prepared to be assembled, and when the metal partition plate 70 is pressed to form the above-mentioned structure, the resilient snaps 710 of the left and right sides are connected to a material tape 93.

Figure 32:
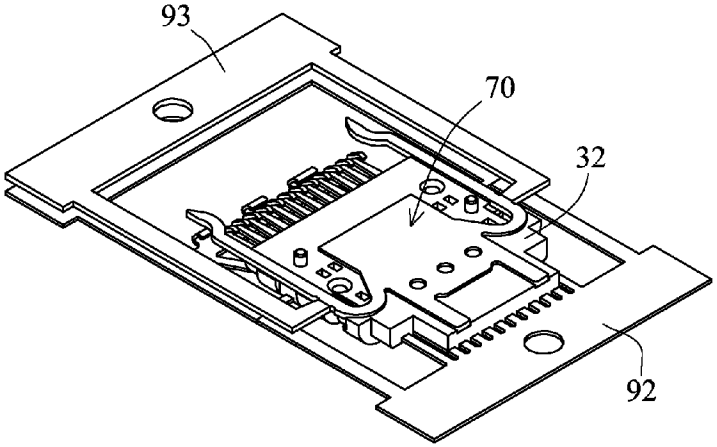
FIG. 32 is a pictorial view showing the manufacturing and assembling processes according to the third embodiment of the invention.

Referring to FIG. 32, the metal partition plate 70 is then assembled with the concave surface 302 of the connection surface of the second seat 31.

Figure 33:
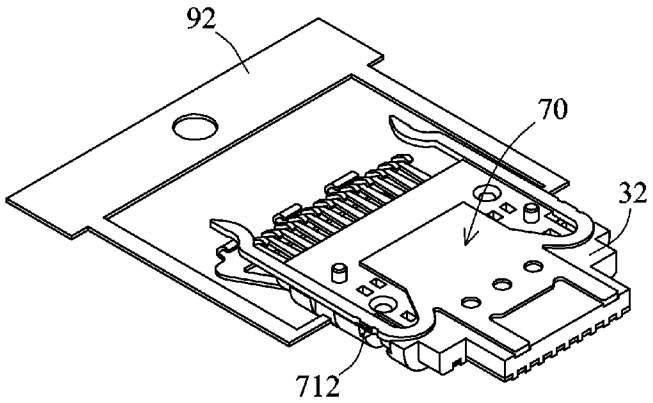
FIG. 33 is a pictorial view showing the manufacturing and assembling processes according to the third embodiment of the invention.

Referring to FIG. 33, the material tape 93 is then separated from the metal partition plate 70, and the rear half section of the material tape 92 is separated, so that each of the resilient snaps 710 of the left and right sides of the metal partition plate 70 is in the form of a separated section 712.

Figure 34:
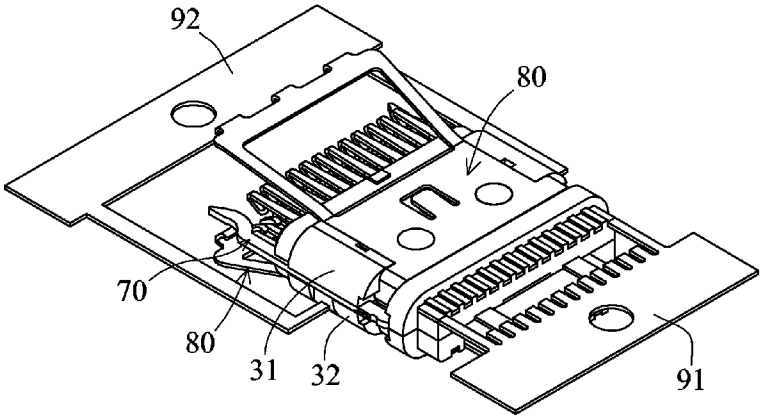
FIG. 34 is a pictorial view showing the manufacturing and assembling processes according to the third embodiment of the invention.

Referring to FIG. 34, the jointing surface of the first seat 31 is then placed on the jointing surface of the first seat 31 to surround the metal partition plate 70.

Figure 35:
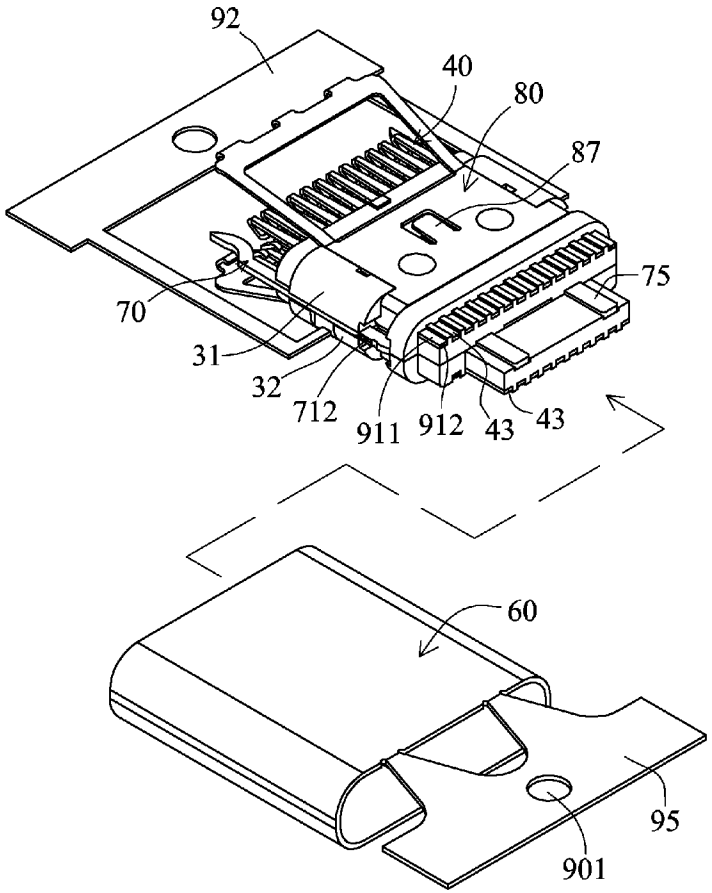
FIG. 35 is a pictorial view showing the manufacturing and assembling processes according to the third embodiment of the invention.

Referring to FIG. 35, the material tape 91 is then separated, the two metal material sheets 911 are combined with the first seat 31 and the rear end is in the form of a separated section 912. At this time, the metal housing 60 is prepared to be assembled from the rear ends of the first and second seats 31 and 32. After the metal housing 60 is pressed, the rear end is connected to a material tape 95.

Figure 36:
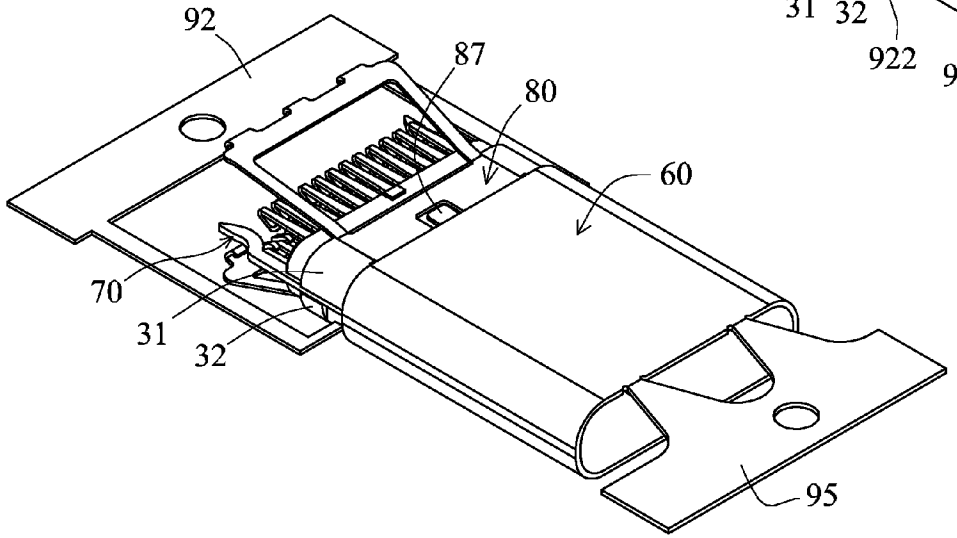
FIG. 36 is a pictorial view showing the manufacturing and assembling processes according to the third embodiment of the invention.

Referring to FIG. 36, the metal housing 60 is pushed frontwards and is firstly fitted with and rests against the middle and rear sections of the first and second seats 31 and 32.

Figure 37:
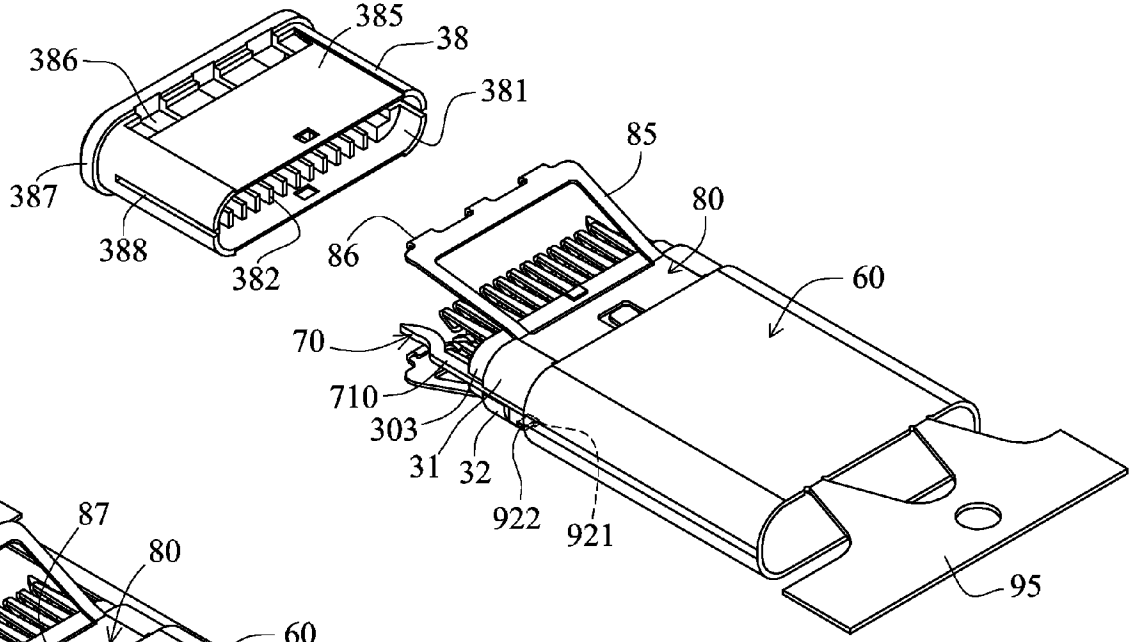
FIG. 37 is a pictorial view showing the manufacturing and assembling processes according to the third embodiment of the invention.

Referring to FIG. 37, the material tape 92 is then separated from the second seat 32. At this time, the two metal material sheets 921 are disposed on two outer sides of the one row of terminals 40 and are separated from the one row of terminals 40, wherein each of the two metal material sheets 921 is formed with a separated section 922 exposed from two sides of the second seat 32. At this time, the jointing portion 38 is prepared to be assembled from the front ends of the first and second seats 31 and 32, wherein the jointing portion 38 is formed by way of plastic injection molding and is the same as the above-mentioned structure, and the fitting portion 381 of the jointing portion 38 can be fit with the fitting portions 303 of the first and second seats 31 and 32.

Figure 38:
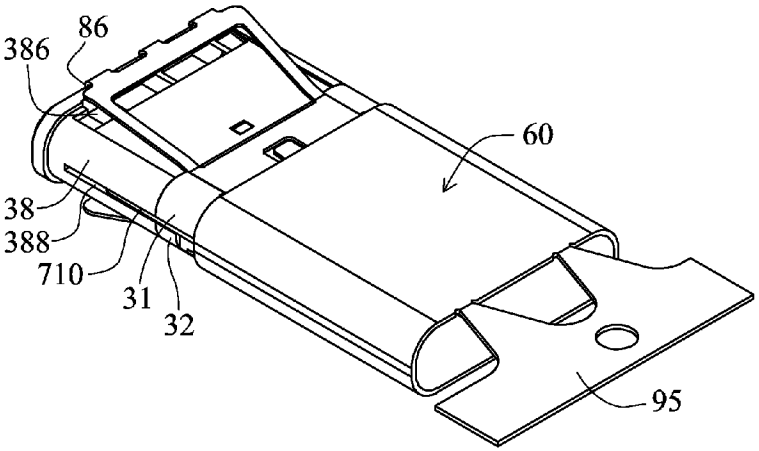
FIG. 38 is a pictorial view showing the manufacturing and assembling processes according to the third embodiment of the invention.

Referring to FIG. 38, the jointing portion 38 is moved, from front to rear, to the front ends of the first and second seats 31 and 32.

Figure 39:
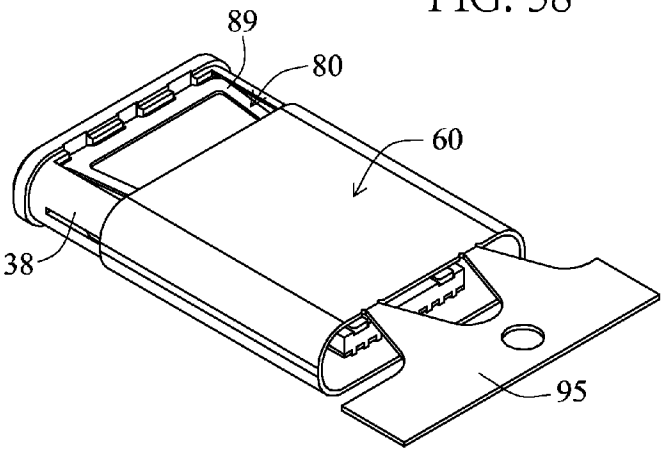
FIG. 39 is a pictorial view showing the manufacturing and assembling processes according to the third embodiment of the invention.

Referring to FIG. 39, the metal housing 60 is further pushed frontwards, and the elastic arm 89 of the grounding sheet 80 is flattened so that three contacts 86 pass through the connection slot in the jointing portion 38 from three openings 386.

Figure 40:
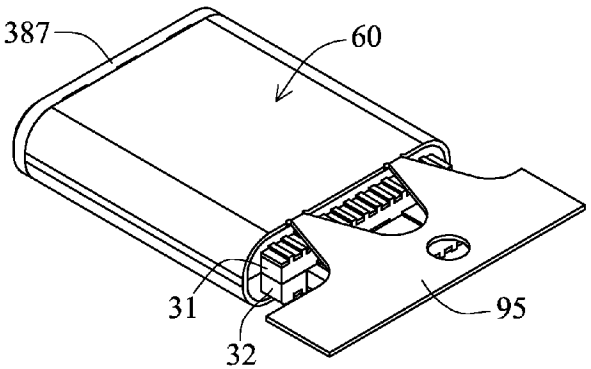
FIG. 40 is a pictorial view showing the manufacturing and assembling processes according to the third embodiment of the invention.

Referring to FIG. 40, the metal housing 60 is further pushed frontwards to rest against and be limited by and flushed with the projecting ring 387.

Figure 41:
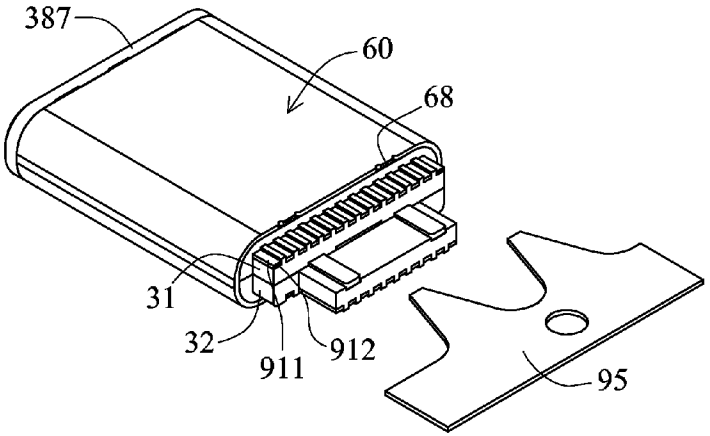
FIG. 41 is a pictorial view showing the manufacturing and assembling processes according to the third embodiment of the invention.

Referring to FIG. 41, the material tape 95 is finally separated from the metal housing 60, and the rear end of the metal housing 60 is in the form of two separated sections 68.

Figure 41A:
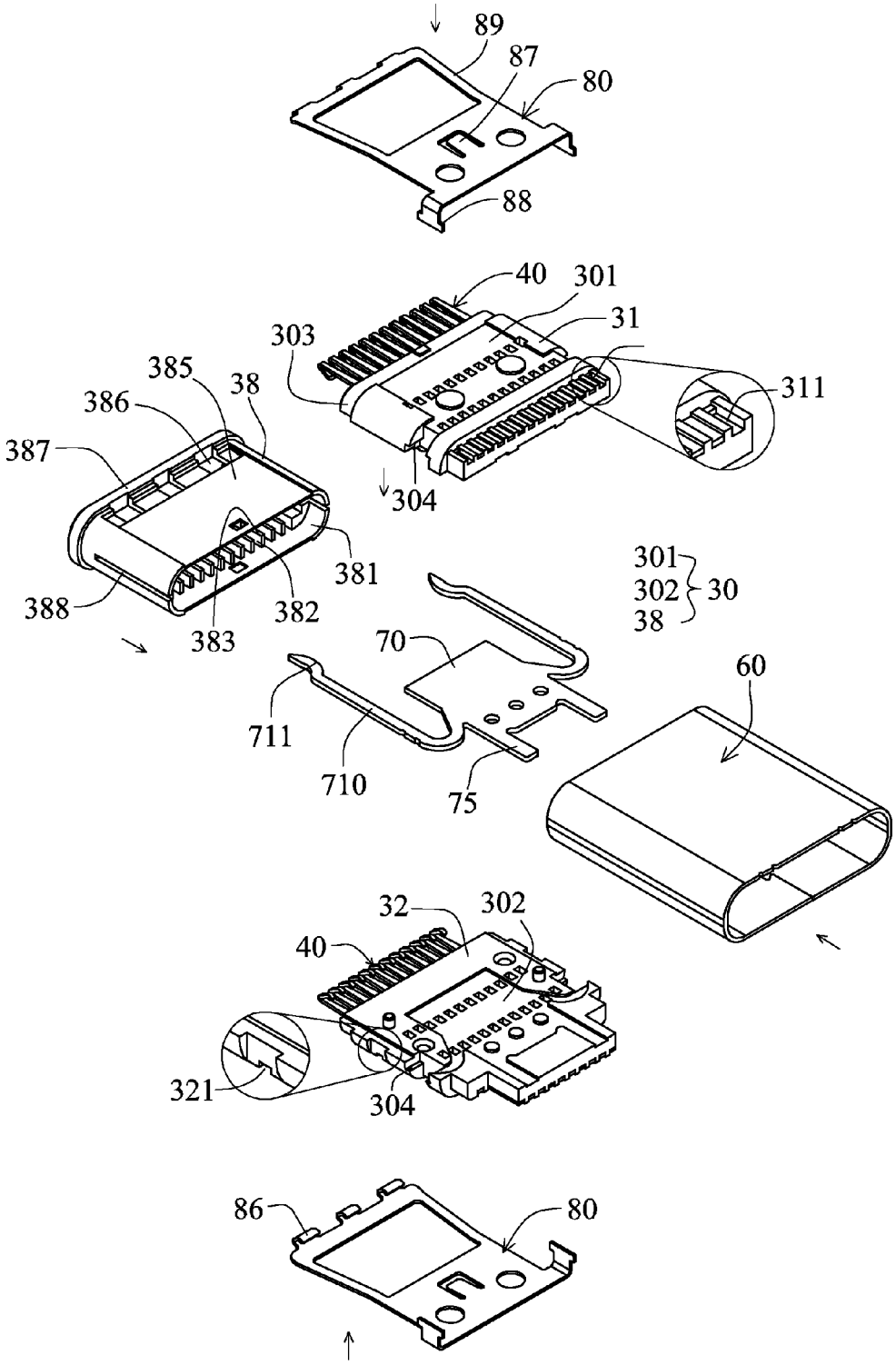
FIG. 41A is another implementary pictorially exploded view according to the third embodiment of the invention.

Referring to FIGS. 41A to 41E, another implementation state of this embodiment has the structure which is substantially the same as that of FIG. 23 except for the difference that, as shown in FIG. 41A, left and right sides of the base seat of the first seat 31 are formed with vertically depressed slots 311 and are disposed on two outer sides of the one row of terminals 40, the tops of the two slots 311 are open to the outside, and are open to the outside on the rear end edge of the second seat 31. Left and right sides of the second seat 32 are formed with vertically depressed slots 321 and are disposed on two outer sides of the one row of terminals 40, wherein the tops of the two slots 321 are open to the outside, and are open to the outside on the left and right side edges of the second seat 32.

Figure 41B:
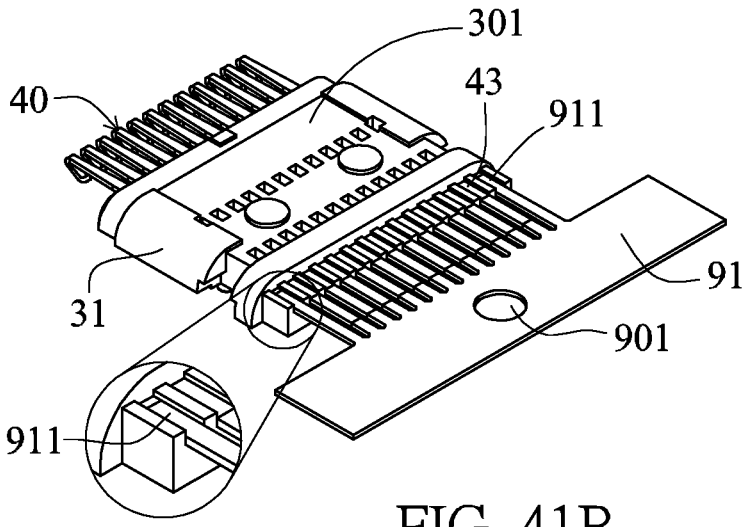
FIG. 41B is a pictorial view showing another implementary manufacturing and assembling process according to the third embodiment of the invention.
Figure 41C:
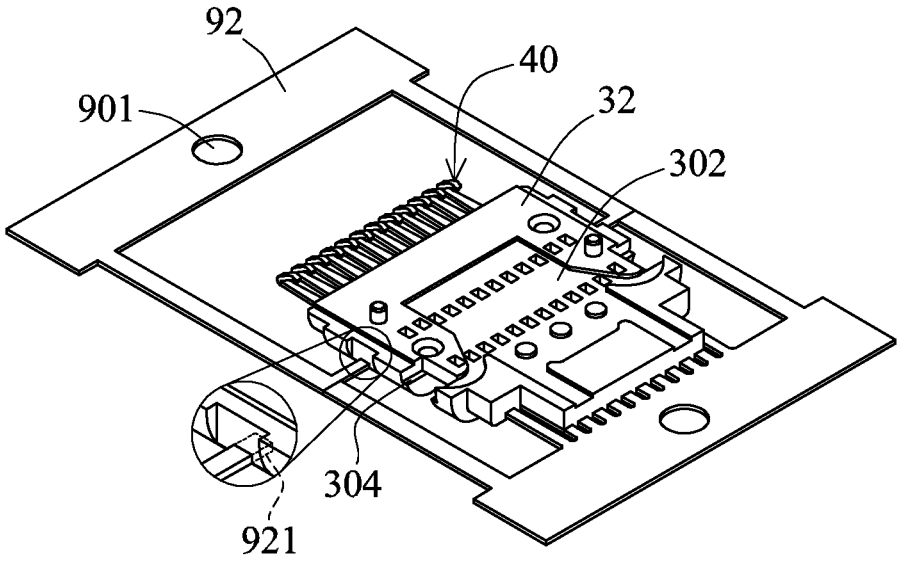
FIG. 41C is a pictorial view showing another implementary manufacturing and assembling process according to the third embodiment of the invention.

The manufacturing and assembling processes are substantially the same as those of FIGS. 27 to 41 except for the difference that, as shown in FIG. 41B, when the terminal pressing and electroplating are finished, the one row of terminals 40 and the two metal material sheets 911 are arranged and connected to a material tape 91 and then embedded and injection molded with the first seat 31, wherein the two metal material sheets 911 are embedded into left and right sides of the rear end of the first seat 31, the front, left, right and bottom surfaces of the metal material sheet 911 are embedded into and fixed to the first seat 31, and only the top surface is open and not embedded. As shown in FIG. 41C, the other one row of terminals 40 and the two metal material sheets 921 are arranged and connected to a material tape 92 and then embedded and injection molded with the second seat 32, wherein the two metal material sheets 921 are embedded into left and right sides of the second seat 32, The four surfaces of the metal material sheet 921 are embedded into and fixed to the second seat 31, and only the bottom surface is open and not embedded.

Figure 41D:
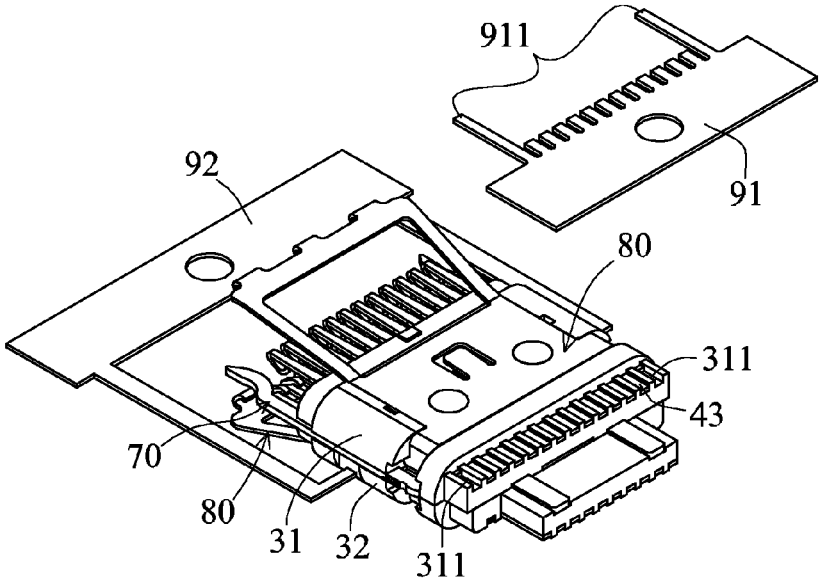
FIG. 41D is a pictorial view showing another implementary manufacturing and assembling process according to the third embodiment of the invention.

As shown in FIG. 41D, the jig exerts an upward force along the rear end of the first seat 31 to push out the two metal material sheets 911 to separate the material tape 91 from the first seat 31. At this time, the two metal material sheets 911 are detached from the first seat 31, and the left and right sides of the base seat of the first seat 31 are formed with vertically depressed slots 311 and are disposed on two outer sides of the one row of terminals 40.

Figure 41E:
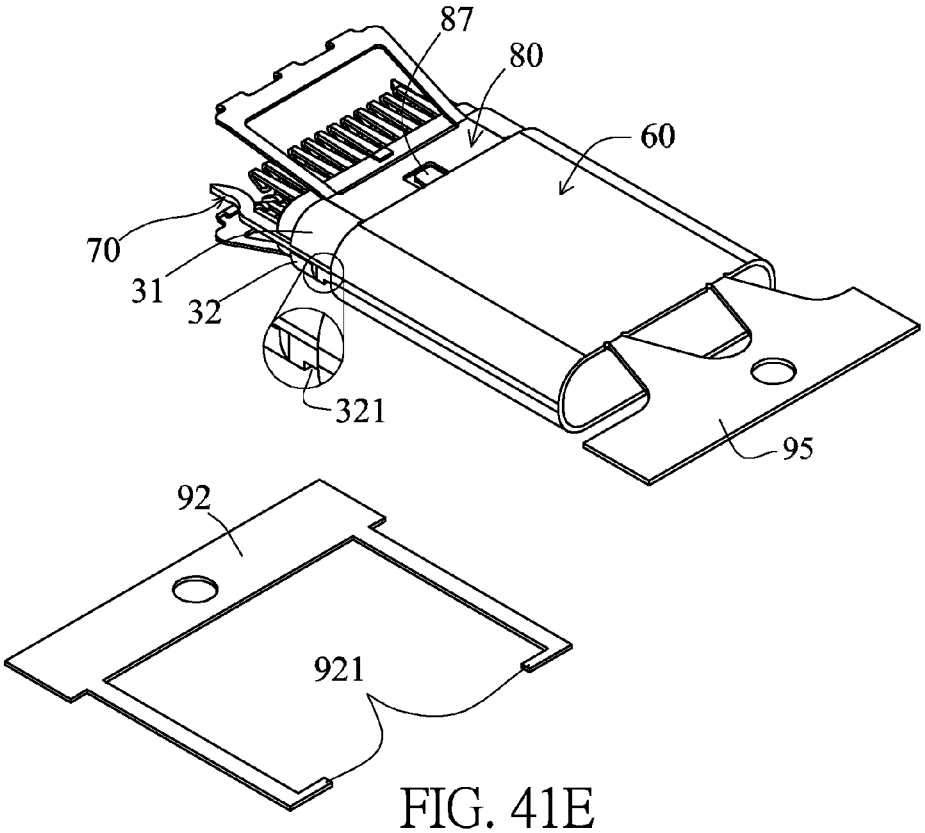
FIG. 41E is a pictorial view showing another implementary manufacturing and assembling process according to the third embodiment of the invention.

As shown in FIG. 41E, the jig exerts a downward force along two side edges of the second seat 32 to push out the two metal material sheets 921 to separate the material tape 92 from the second seat 32. At this time, the two metal material sheets 921 are detached from the second seat 32, and the left and right sides of the second seat 32 are formed with vertically depressed slots 321 and are disposed on two outer sides of the one row of terminals 40.

Figure 43:
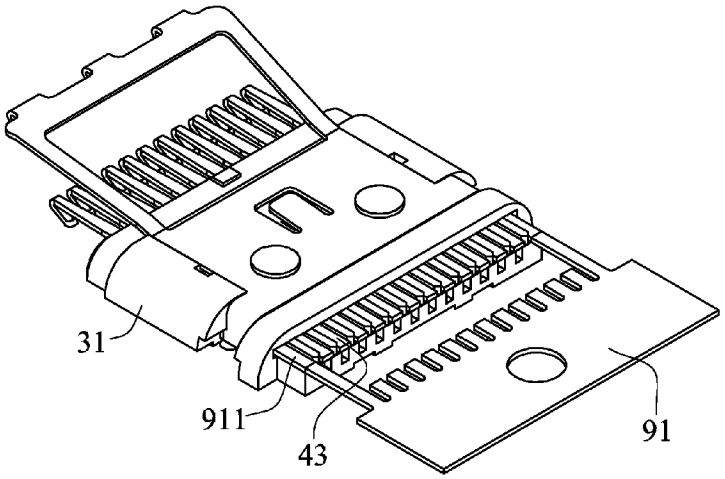
FIG. 43 is a pictorially assembled partial view according to the fourth embodiment of the invention.
Figure 42:
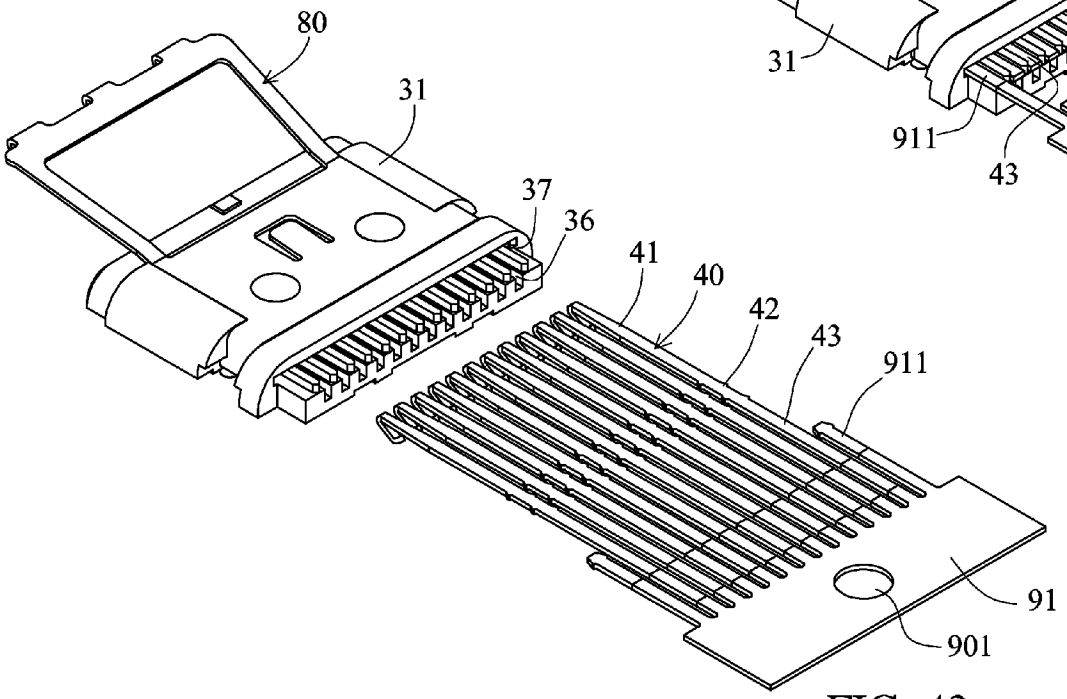
FIG. 42 is a pictorially exploded partial view according to the fourth embodiment of the invention.

Referring to FIGS. 42 and 43, the fourth embodiment of the invention is substantially the same as the third embodiment except for the difference that the first seat 31 of this embodiment is provided with one row of terminal slots 36 and two metal material sheet slots 37. Referring to FIG. 21, the one row of terminals 40 and the two metal material sheets 911 are arranged and connected to the material tape 91 assembled with the one row of terminal slots 36 and two metal material sheet slots 37, and then the pins 43 of the one row of terminals 40 are separated from the material tape 91 and bent. At this time, the first seat 31 is still connected to the material tape 91 through the two metal material sheets 911.

Figure 44:
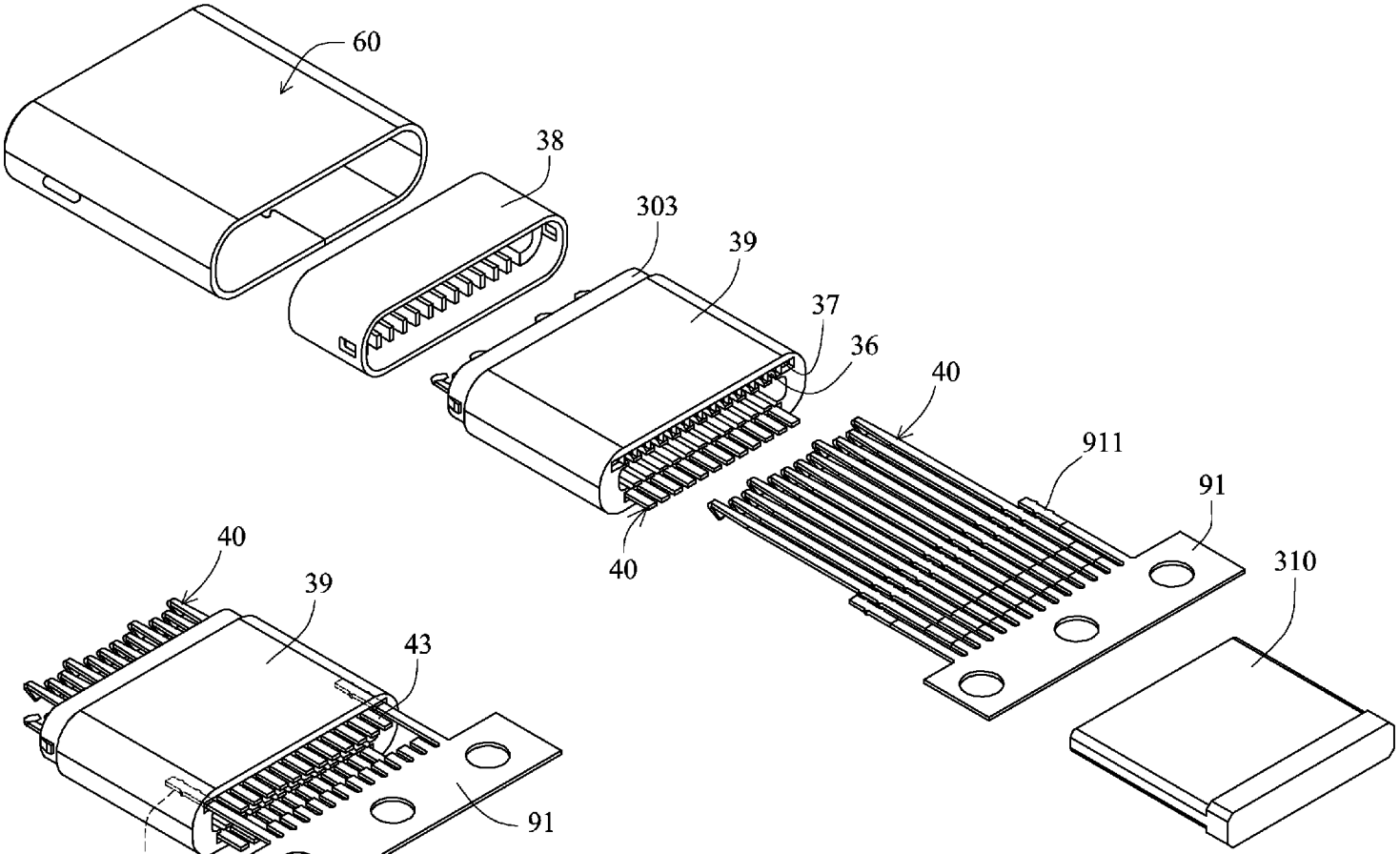
FIG. 44 is a pictorially exploded view according to the fifth embodiment of the invention.
Figure 45:
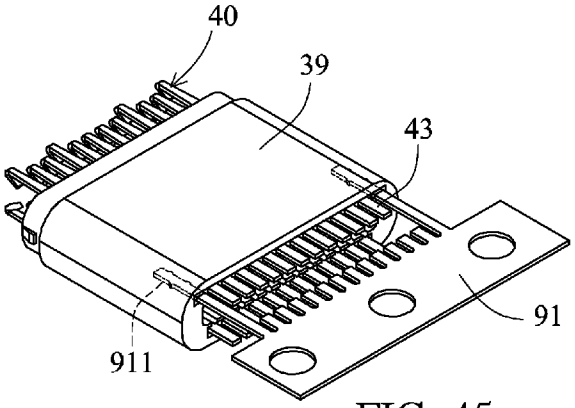
FIG. 45 is a pictorially assembled partial view according to the fifth embodiment of the invention.

Referring to FIGS. 44 and 45, the fifth embodiment of the invention is substantially the same as the third embodiment except for the difference that the base seat 39 of this embodiment is integrally formed with a plastic seat, and is not provided with the metal partition plate and the grounding sheet, and the base seat 39 is provided with two rows of terminal slots 36 assembled with two rows of terminals 40, wherein each of two sides of the upper row of terminal slots 36 is provided with a metal material sheet slot 37. In addition, the inside of the base seat 39 forms a hollow cavity slot filled with a rear plug member 310. Referring to FIG. 45, the one row of terminals 40 and the two metal material sheets 911 are arranged and connected to a material tape 91 assembled with the upper row of terminal slots 36 and two metal material sheet slots 37, and then the pins 43 of the one row of terminals 40 are separated from the material tape 91 and bent. At this time, the base seat 39 is still connected to the material tape 91 through the two metal material sheets 911.

Figure 46A:
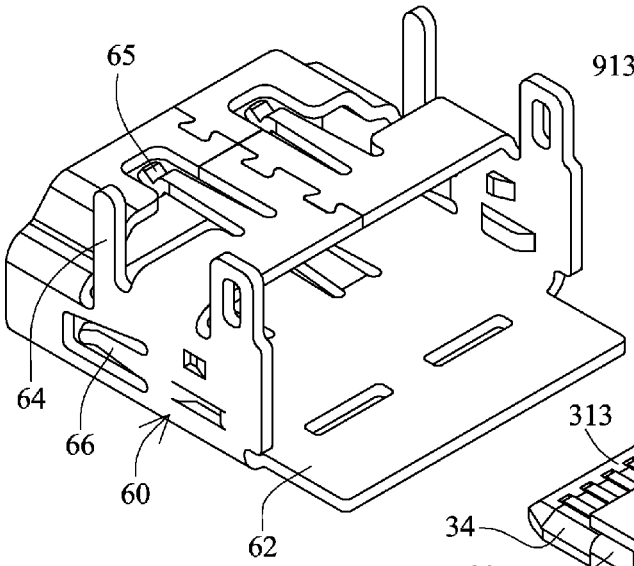
FIG. 46A is a pictorial view showing the metal material sheet 911 according to the sixth embodiment of the invention.
Figure 46A:
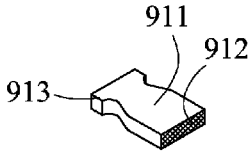
Figure 46B:
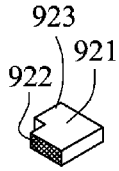
FIG. 46B is a pictorial view showing the metal material sheet 921 according to the sixth embodiment of the invention.
Figure 46:
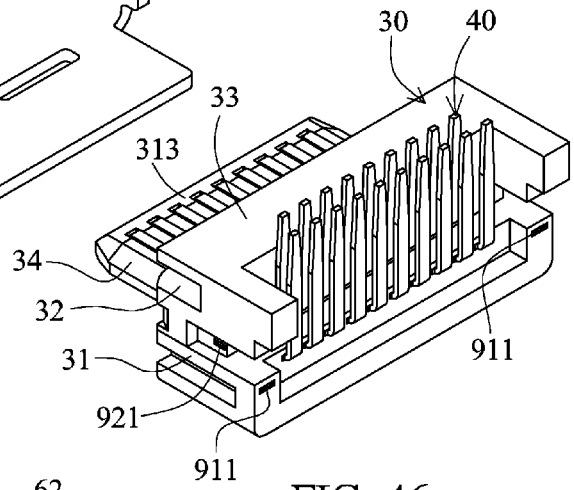
FIG. 46 is a pictorially exploded view according to the sixth embodiment of the invention.
Figure 48:
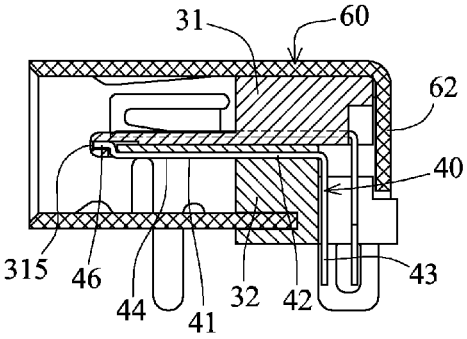
FIG. 48 is a side cross-sectional view according to the sixth embodiment of the invention.
Figure 47:
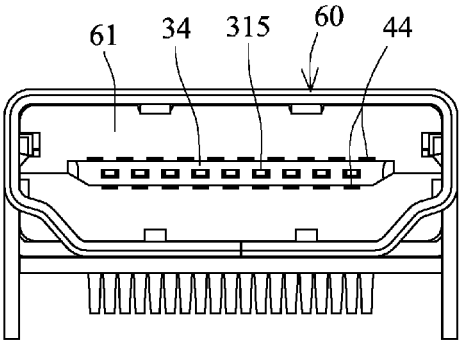
FIG. 47 is a front view according to the sixth embodiment of the invention.

Referring to FIGS. 46 to 48, the sixth embodiment of the invention is a high definition multimedia interface (referred to as HDMI) electrically connected to the socket, and comprises an insulated seat 30, two rows of terminals 40 and a metal housing 60.

The insulated seat 30 is made of a plastic material and provided with a base seat 33 and a jointing portion 34, the front end of the base seat 33 is projectingly provided with the tongue-like jointing portion 34, the two opposite surfaces of the larger area of the jointing portion 34 are two connection surfaces, the thickness of the base seat 33 is larger than that of the jointing portion 34, the jointing portion 34 has a wide top portion and a narrow bottom portion so that lower sections of left and right sides are in the form of inclined edges, the insulated seat 30 is provided with a first seat 31 and a second seat 32 vertically stacked, the first and second seats 31 and 32 are embedded and injection molded with the one row of first terminals 40, respectively, the first seat 31 is formed with the jointing portion and the upper portion of the base seat, the second seat 32 is formed with the jointing portion and the lower portion of the base seat, and the front end of the jointing portion of the first seat 31 projects downwardly to form the full height of the front edge of the jointing portion 33 and form, on the connection surface, a convex surface 313 and one row of nine slots 315.

The two rows of terminals 40 have one row of ten terminals embedded and injection molded with the first seat 31, and one row of nine terminals embedded and injection molded with the second seat 32, respectively. The terminal 40 is integrally pressed and bent to provide an extension 41, a fixing portion 42 and a pin 43. Partial top and bottom surfaces of the fixing portion 42 are embedded and fixed into the first seat 31 (second seat 32). The extension 41 is connected to the front end of the fixing portion 42 and extends to the jointing portion 34. The inner surface of the extension 41 is embedded into, in flat surface contact with and fixed to the jointing portion and the outer surface of the extension is exposed from the outer surface of the jointing portion to form a contact 44, so the extension 41 is fixed and elastically non-movable, the pin 43 is connected to the rear end of the fixing portion 42 and extends out of the base seat and have vertical distal sections, the contacts 44 of the two rows of terminals 40 are disposed on two connection surfaces of the jointing portion 34, respectively, and staggered in the left-right direction, the contacts 44 of the two rows of terminals 40 do not have the same contact interface, and the front ends of the nine terminals 40 of the second seat 32 are convex upwardly to provide engaging projections 46 projecting upwards beyond the front end of the second seat 32.

When the first and second seats 31 and 32 are vertically combined together, the engaging projections 46 of the one row of terminals 40 of the second seat 32 engage into one row of slots 315 of the first seat 31, and the front edge of the jointing portion of the second seat 32 is connected and flush with the convex surface 313.

The metal housing 60 covers the insulated seat 30. The metal housing 30 and the base seat 33 rest against and engage with each other, and the inner front section thereof is formed with a connection slot 61, which covers the jointing portion 34, and into which the fitting portion of an electrical connection plug can be inserted. The jointing portion 34 is horizontally disposed at a middle height of the connection slot 61 and extends frontwards. The inlet of the connection slot 61 faces frontwards. Two connection surfaces of the jointing portion 34 form asymmetrical spaces. The shape of the connection slot 61 has a wide top portion and a narrow bottom portion so that lower sections of left and right sides are in the form of inclined edges 67, the metal housing 60 is provided with a rear plate 62 disposed in back of the insulated seat 30, each of the left and right sides provided downward with two vertical plate connecting sheets 64, top and bottom plate surfaces are prodded inwardly projecting provided with two resilient snaps 65, and left and right plate surfaces are prodded inwardly projecting provided with two grounding elastic sheets 66.

This embodiment is characterized in that each of the two sides of the base seat of the first seat 31 is provided with a metal material sheet 911. The two metal material sheets 911 are disposed on two outer sides of the one row of terminals 40 and are separated from the one row of terminals 40. Each of first ends of the two metal material sheets 911 is provided with a hook 913 locked with the base seat of the first seat 31, and each of second ends of the two metal material sheets 911 is provided with a separated section 912 exposed from the rear end of the base seat of the first seat 31. Each of the two sides of the base seat of the second seat 32 is provided with a metal material sheet 921. The two metal material sheets 921 are disposed on two outer sides of the one row of terminals 40 and are separated from the one row of terminals 40. The two metal material sheets 921 have first ends each provided with a hook 923 locked the base seat of the first seat 32 and second ends each provided with a separated section 922 exposed from the left and right sides of the base seat of the second seat 32.

Figure 51:
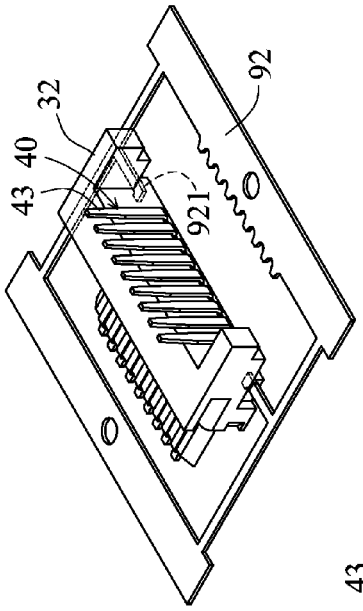
FIG. 51 is a pictorial view showing the manufacturing and assembling processes according to the sixth embodiment of the invention.
Figure 51:
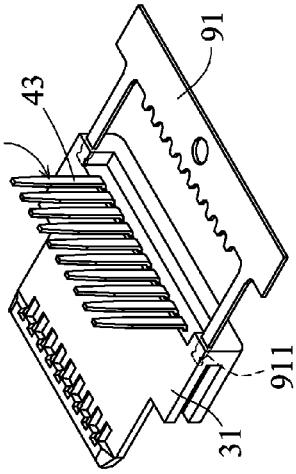
Figure 50:
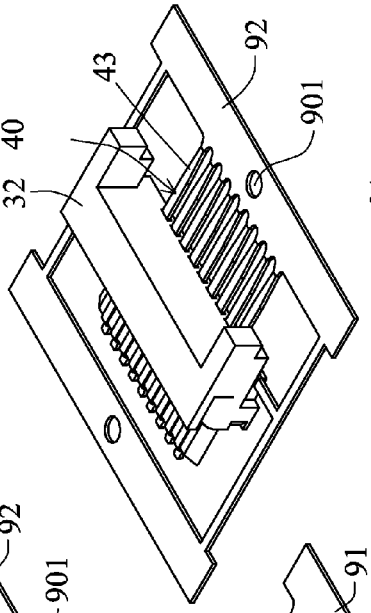
FIG. 50 is a pictorial view showing the manufacturing and assembling processes according to the sixth embodiment of the invention.
Figure 50:
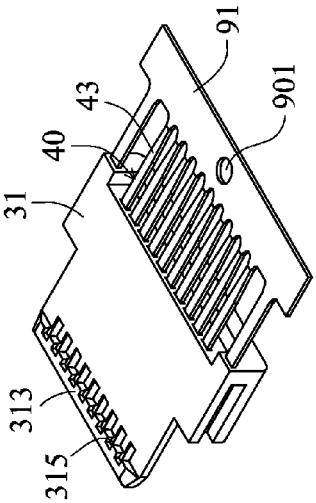
Figure 49:
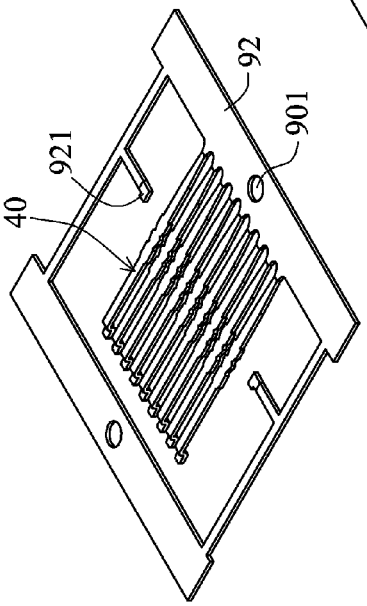
FIG. 49 is a pictorial view showing the manufacturing and assembling processes according to the sixth embodiment of the invention.
Figure 49:
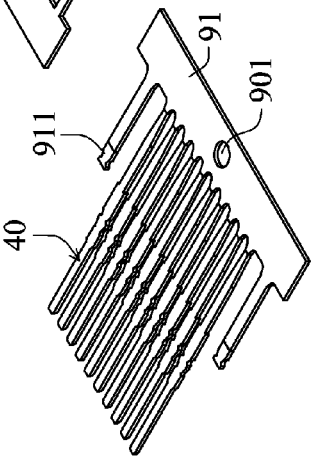

Referring to FIGS. 49 to 51, the manufacturing processes of this embodiment will be described in brief. Referring to FIGS. 49 and 50, when the terminal pressing and electroplating are finished, the one row of terminals 40 and the two metal material sheets 911 are arranged and connected to a material tape 91 and then embedded and injection molded with the first seat 31 to form the above-mentioned structure, the one row of terminals 40 and two metal material sheets 921 are arranged and connected to a material tape 92, and then embedded and injection molded with the first seat 32 to form the above-mentioned structure.

Referring to FIG. 51, the pins 43 of the one row of terminals 40 on the first seat 31 are cut and thus separated from the material tape 91. At this time, the first seat 31 is still connected to the material tape 91 through the two metal material sheets 911, the pins 43 of the one row of terminals 40 on the second seat 32 are cut and thus separated from the material tape 92. At this time, the second seat 32 is still connected to the material tape 92 through the two metal material sheets 921, the material tapes 91 and 92 are provided with position guiding hole 901 and can be assembled in conjunction with the automatic assembling machine and are thus beneficial to automatic assembly of the first seat 31, the second seat 32 and the metal housing 60, and the metal housing 60 may also be connected to a material tape when being manufactured.

Figure 53:
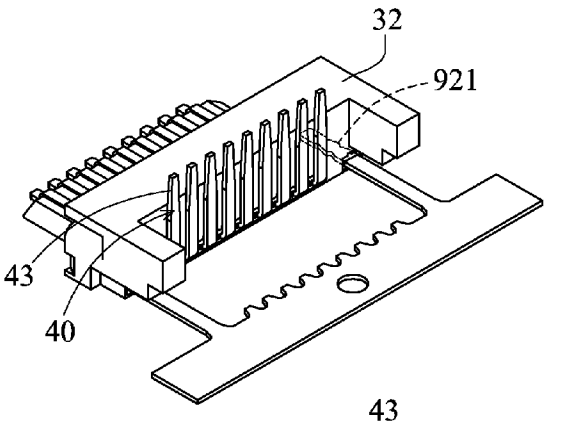
FIG. 53 is a pictorially assembled partial view according to the seventh embodiment of the invention.
Figure 53:
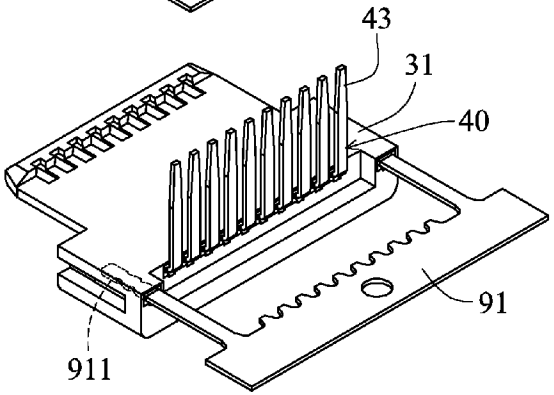
Figure 52:
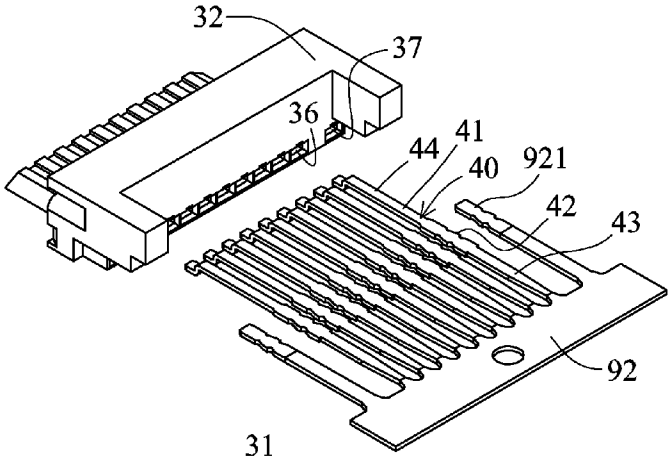
FIG. 52 is a pictorially exploded partial view according to the seventh embodiment of the invention.
Figure 52:
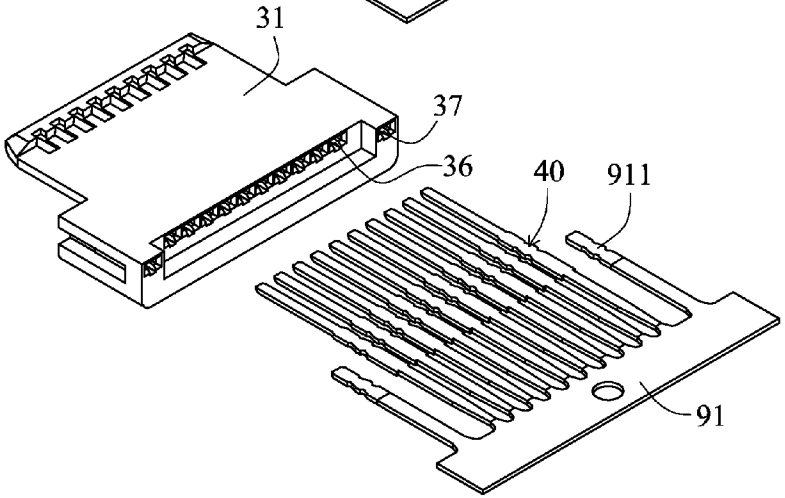

Referring to FIGS. 52 and 53, the seventh embodiment of the invention is substantially the same as the sixth embodiment except for the difference that each of the first and second seats 31 and 32 of this embodiment is provided with one row of terminal slots 36 and two metal material sheet slots 37. Referring to FIG. 52, the one row of terminals 40 and the two metal material sheets 911 are arranged and connected to a material tape 91 assembled with the one row of terminal slots 36 of the first seat 32 and the two metal material sheet slots 37, and the pins 43 of the one row of terminals 40 are separated from the material tape 91 and bent. At this time, the first seat 31 is still connected to the material tape 91 through the two metal material sheets 911 after the two metal material sheets 911 are separated from the material tape 91. Each of two metal material sheets 911 forms a separated section exposed from the rear end of the base seat of the first seat 31. The one row of terminals 40 and the two metal material sheets 921 are arranged and connected to a material tape 92 assembled with the one row of terminal slots 36 of the second seat 32 and the two metal material sheet slots 37, and the pins 43 of the one row of terminals 40 are separated from the material tape 92 and bent. At this time, the second seat 32 is still connected to the material tape 92 through the two metal material sheets 921. When the two metal material sheets 921 are separated from the material tape 91, each of the two metal material sheets 921 forms a separated section exposed from the rear end of the base seat of the second seat 32.

Referring to FIGS. 54 to 57, the eighth embodiment of the invention is substantially the same as the first embodiment except for the difference that this embodiment is a MICRO USB 3.0 socket, which comprises an insulated seat 30, one row of terminals 40 and a metal housing 60.

The insulated seat 30 is made of a plastic material and provided with a base seat 33 and a jointing portion 34. The front end of the base seat 33 is projectingly provided with two tongue-like jointing portions 34. The bottom surface of the jointing portion 34 is a connection surface, and the thickness of the base seat 33 is larger than that of the jointing portion 34.

The one row of terminals 40 are embedded and injection molded or assembled with and fixed to the insulated seat 30. The one row of terminals 40 comprise two sets of five terminals 40. The terminal 40 is integrally pressed and bent to provide an extension 41, a fixing portion 42 and a pin 43. The fixing portion 42 is fixed to the base seat. The extension 41 is connected to the front end of the fixing portion 42 and extends to the jointing portion 34. The inner surface of the extension 41 is in flat surface contact with and fixed to the jointing portion 34. The outer surface of the extension 41 is exposed from the jointing portion to form a contact 44. So, the extension 41 is fixed and elastically non-movable. The metal housing 60 covers the insulated seat 30. The metal housing 30 and the base seat 33 rest against and engage with each other, and the inner front section thereof is formed with a connection slot 61, which covers the jointing portion 34, and into which the fitting portion of an electrical connection plug can be inserted. The jointing portion 34 is horizontally disposed at a middle height of the connection slot 61 and extends frontwards. The inlet of the connection slot 61 faces frontwards.

Figure 54:
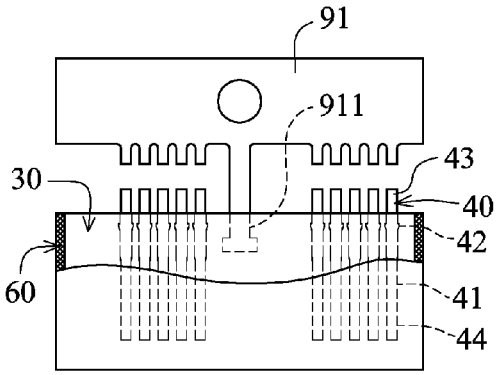
FIG. 54 is a top view showing the manufacturing and assembling processes according to the eighth embodiment of the invention.
Figure 56:
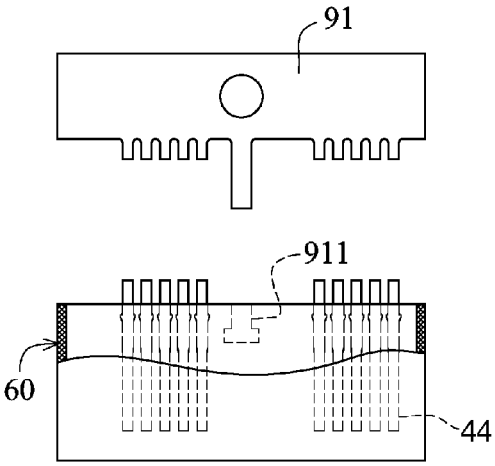
FIG. 56 is a top view showing the manufacturing and assembling processes according to the eighth embodiment of the invention.
Figure 55:
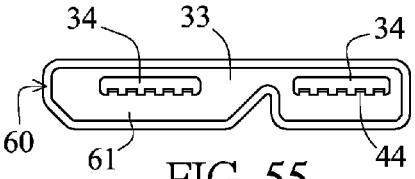
FIG. 55 is a front view showing the manufacturing and assembling processes according to the eighth embodiment of the invention.

The manufacturing and assembling processes of this embodiment are substantially the same as those of the first embodiment, as shown in FIG. 54, that is, the one row of terminals 40 and the material tape 91 are formed by pressing a metal sheet. After a metal material sheet 911 connected to the one row of terminals 40 and the material tape 91 is embedded and injection molded or assembled with and fixed to the insulated seat 30, and after the pins 43 of the one row of terminals 40 are separated from the material tape, the material tape 91 is fixedly combined with the insulated seat 30 through the metal material sheet 911. As shown in FIG. 55, when the material tape 91 is separated from the insulated seat 30 by way of cutting, the metal material sheet 921 is disposed at the middle of the one row of terminals 40 and is separated from the one row of terminals 40, and the metal material sheet 921 forms a separated section exposing the middle section of the rear end of the base seat of the insulated seat 30.

Figure 57:
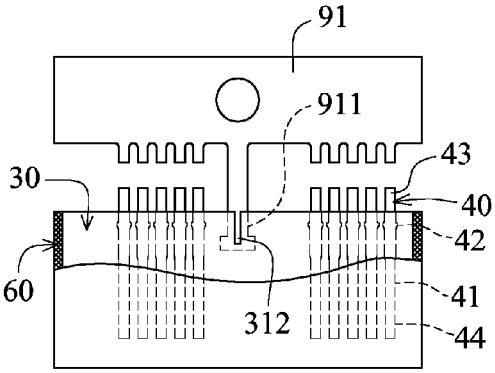
FIG. 57 is a top view showing the manufacturing and assembling processes according to the ninth embodiment of the invention.
Figure 59:
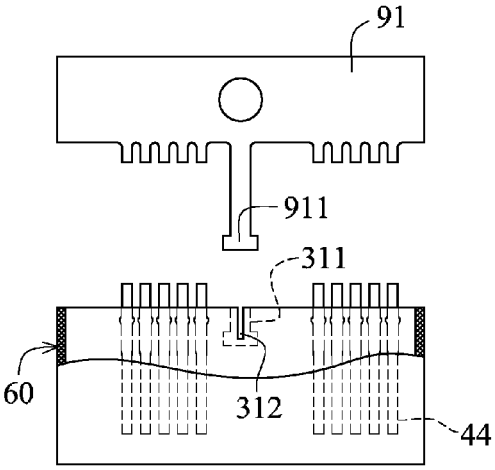
FIG. 59 is a top view showing the manufacturing and assembling processes according to the ninth embodiment of the invention.
Figure 58:
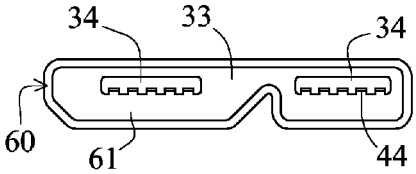
FIG. 58 is a front view showing the manufacturing and assembling processes according to the ninth embodiment of the invention.

Referring to FIGS. 57 to 59, the ninth embodiment of the invention is substantially the same as the eighth embodiment except for the difference that this embodiment. As shown in FIG. 59, wherein the metal material sheet 911 is pushed away by way of insertion from the through hole 312 of the insulated seat to separate the material tape 91 from the insulated seat 30, so that the middle section of the rear end of the base seat of the insulated seat 30 is formed with a vertically depressed slot 311. The bottom of the slot 311 is open to the outside and the rear end edge of the second seat 31 is open to the outside. The through hole 312 penetrates from the top surface of the first seat 31 to the slot 311.

Figure 61:
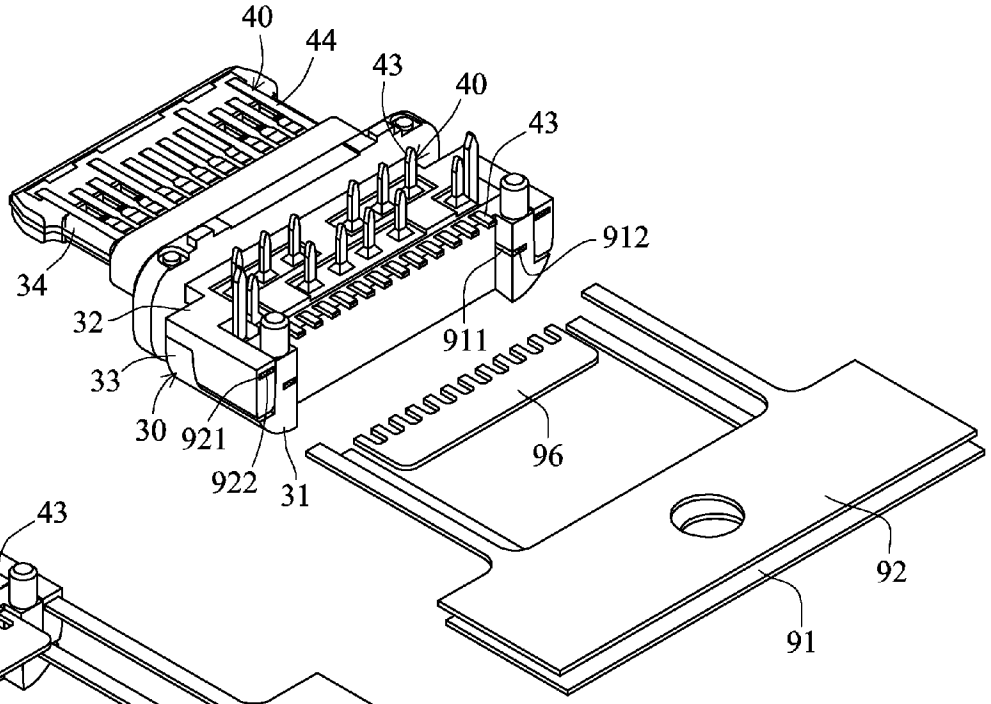
FIG. 61 is a pictorial view showing the manufacturing and assembling processes according to the tenth embodiment of the invention.
Figure 60:
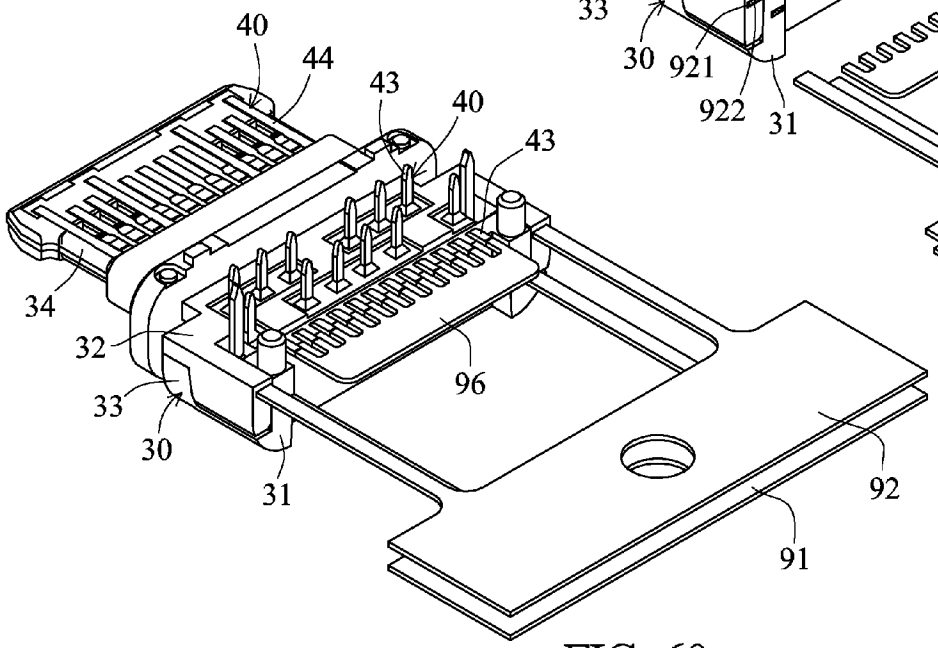
FIG. 60 is a pictorial view showing the manufacturing and assembling processes according to the tenth embodiment of the invention.
Figure 60A:
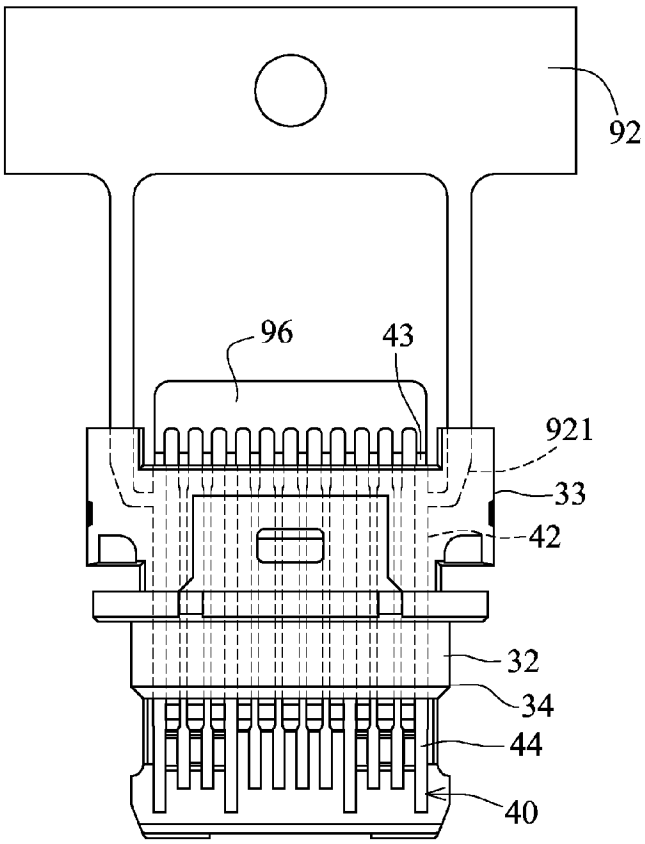
FIG. 60A is a top view showing the manufacturing and assembling processes according to the tenth embodiment of the invention.

Referring to FIGS. 60, 60A and 61, the tenth embodiment of the invention is substantially the same as the first embodiment except for the difference that as shown in FIGS. 60 and 60A, the two metal material sheets 921 of the material tape 92 of this embodiment are integrally connected to the fixing portions 42 of the terminals 40 of the two sides of the one row of terminals 40, respectively. The metal material sheet 921 is embedded into two sides of the rear end of the base seat of the second seat 32, the two metal material sheets 921 and the material tape 92 are at the same height, the distal sections of the one row of terminals 40 of the pins 43 are horizontal and connected together through a material bridge 96, and the material bridge 96 and the pins 43 of the one row of terminals 40 are separated from the material tape 92. As shown in FIG. 61, when the material tape 92 is separated from the second seat 32 by way of cutting, the two metal material sheets 921 are disposed on left and right sides of the base seat of the insulated seat 30, and the metal material sheet 921 forms a separated section 922 exposing left and right sides of the rear end of the base seat of the insulated seat 30. In addition, the separated section 922 of the metal material sheet 921 and horizontal portions of the distal sections of the pins 43 of the one row of terminals 40 have different heights.

The configurations of the material tape 91, the two metal material sheets 911, the one row of terminals 40 and the first seat 31 are the same as those mentioned hereinabove. Because the distal sections of the pins 43 of one row of terminals 40 of the first seat 31 are vertical, it is unnecessary to provide the material bridge 96 for connection.

The distal sections of the pins 43 of one row of terminals 40 of the second seat 32 are horizontal and connected together through the material bridge 96, so that the consistent flatness of the distal sections of the pins 43 of the one row of terminals 40 can be further ensured in the assembling process.

Two side terminals integrally connected to the two metal material sheets 911 (921) are the grounding terminals So, even if the two metal material sheets 911(921) contacts the metal housing 60, the functionality still cannot be affected.

Two metal material sheets 911 (921) and two side terminals of the one row of terminals 40 are integrally connected together to enhance the fixed combination of the metal material sheet and the insulated seat, and the terminals are more stable upon being pressed, electroplated, embedded or assembled. The semi-finished product may be firmer in the assembling process to achieve the convenience in manufacturing.

However, if the two side terminals integrally connected to two metal material sheets 911 (921) are not grounded, then the two metal material sheets 911 (921) are configured such that the insulated seat 30 is slightly depressed to avoid the contacting with the metal housing 60.

In addition, the two metal material sheets 911 (921) may also be configured to be kept on the front end of the insulated seat 30 according to the design requirement.

Figure 62A:
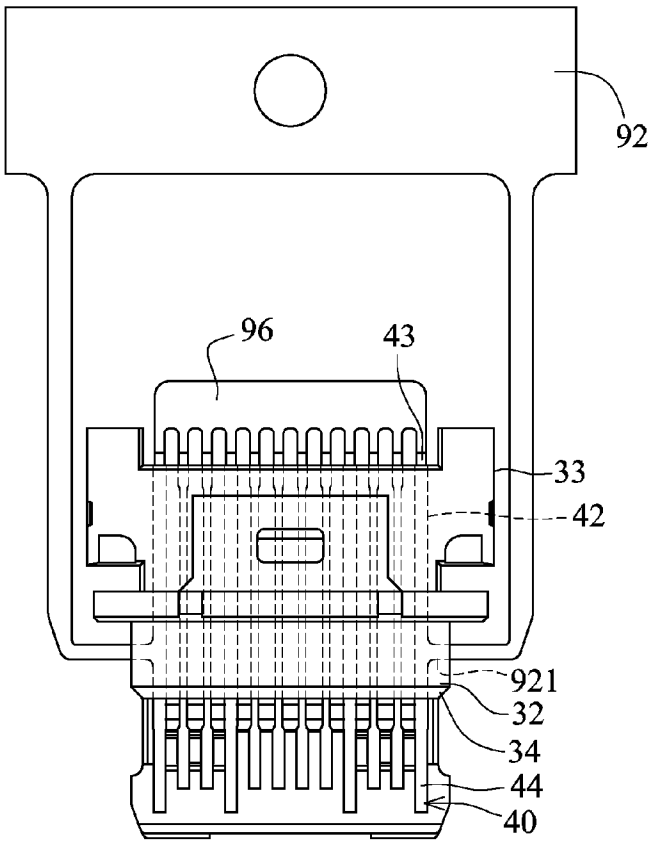
FIG. 62A is a top view showing the manufacturing and assembling processes according to the eleventh embodiment of the invention.
Figure 63:
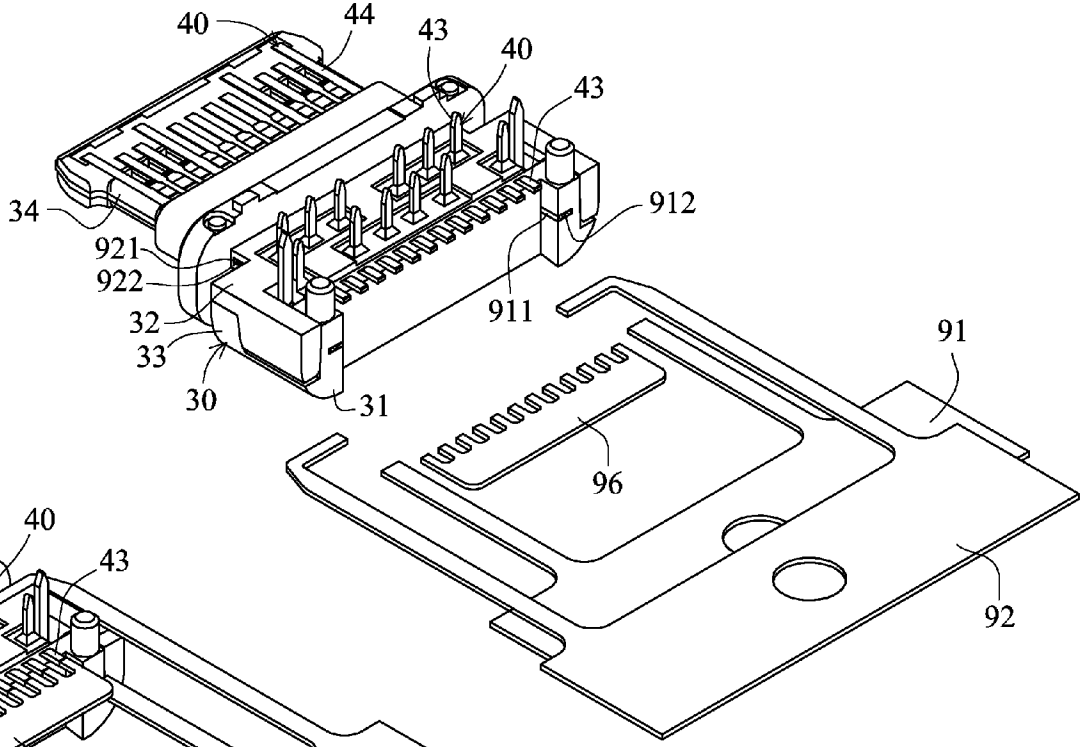
FIG. 63 is a pictorial view showing the manufacturing and assembling processes according to the eleventh embodiment of the invention.
Figure 62:
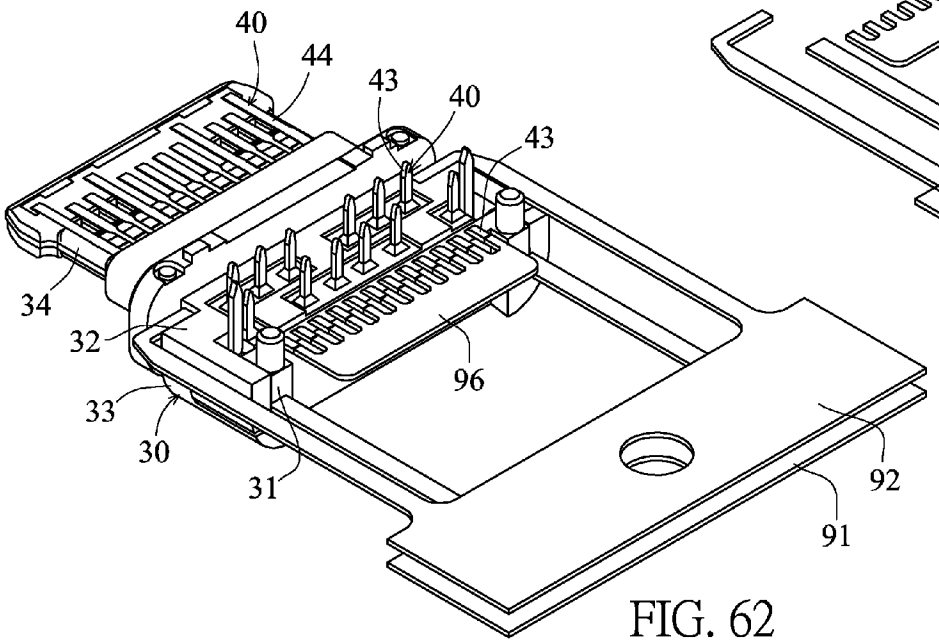
FIG. 62 is a pictorial view showing the manufacturing and assembling processes according to the eleventh embodiment of the invention.

Referring to FIGS. 62, 62A and 63, the eleventh embodiment of the invention is substantially the same as the tenth embodiment. As shown in FIG. 62A, the two metal material sheets 911 of the material tape 92 of this embodiment are also integrally connected to the fixing portions 42 of the terminals 40 of the two sides of the one row of terminals 40, respectively, except for the difference that the two metal material sheets 911 are embedded into the left and right sides of the base seat of the second seat 32. As shown in FIG. 62, when the material tape 92 is separated from the second seat 32 by way of cutting, the two metal material sheets 921 are disposed on the left and right sides of the base seat of the insulated seat 30, and the metal material sheet 921 forms a separated section 922 exposing left and right sides of the base seat of the insulated seat 30.

The configurations of the material tape 91, the two metal material sheets 911, the one row of terminals 40 and the first seat 31 are the same as those of the tenth embodiment.

Figure 65:
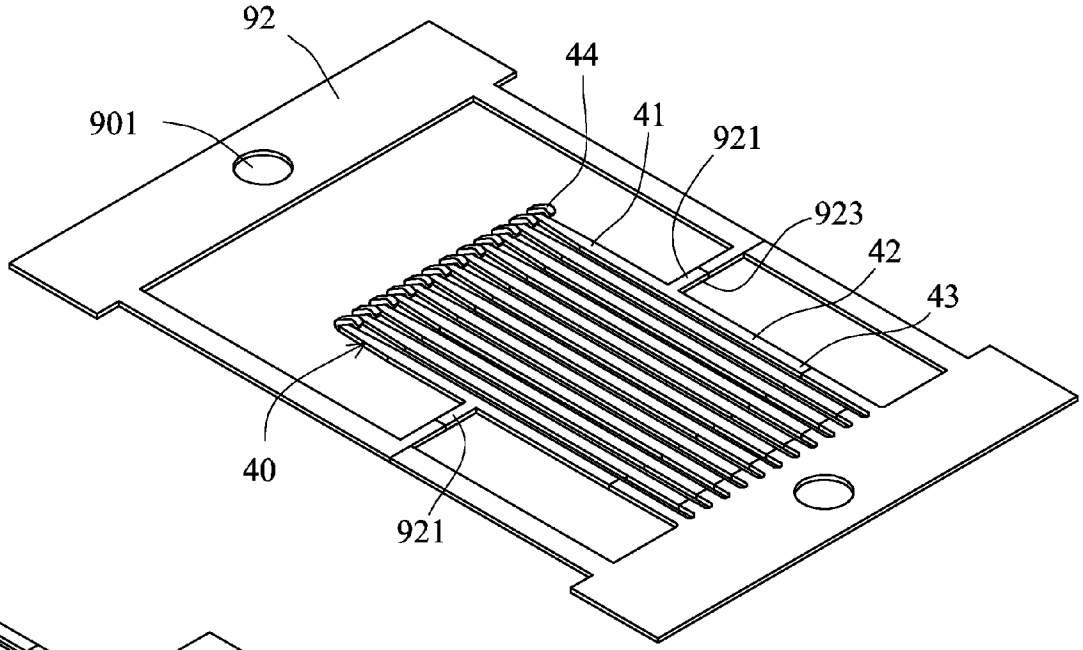
FIG. 65 is a pictorial view showing the manufacturing and assembling processes according to the twelfth embodiment of the invention.
Figure 64:
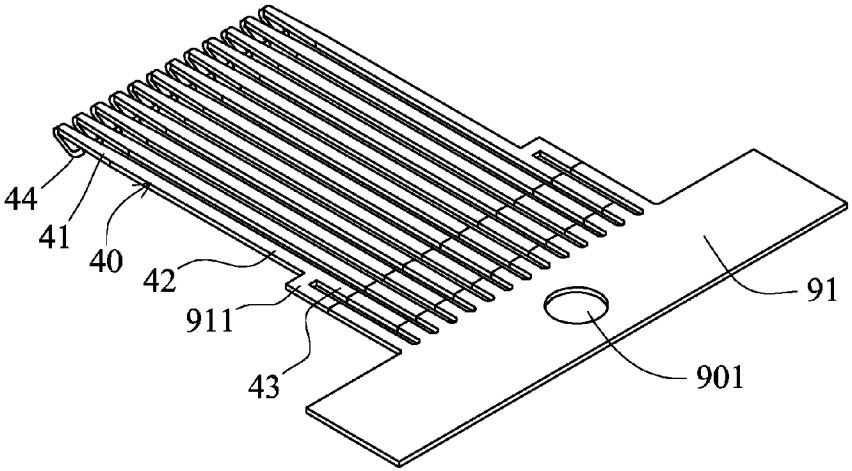
FIG. 64 is a pictorial view showing the manufacturing and assembling processes according to the twelfth embodiment of the invention.

Referring to FIGS. 64 and 65, the twelfth embodiment of the invention is substantially the same as the third embodiment except for the difference regarding the two sides of the terminals 40 of the one row of terminals 40 embedded with the first seat, as shown in FIG. 64, wherein the two metal material sheets 911 have first ends connected to the material tape 91, and second ends integrally connected to the fixing portions 42 of the terminals 40 of the two sides of the one row of terminals 40, respectively. As shown in FIG. 65 regarding the two sides of the terminals 40 of the one row of terminals 40 embedded with the second seat, the two metal material sheets 921 have first ends connected to the material tape 92, and second ends integrally connected to the fixing portions 42 of the terminals 40 of the two sides of the one row of terminals 40, respectively.

Two side terminals integrally connected to two metal material sheets 911 (921) are the grounding terminals, so the functionality cannot be affected. So, the metal material sheet 921 is electrically connected to only one of the terminals 40 and is insulated from remaining ones of the contacts 44 of the terminals 40.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An electrical connector, comprising:

an insulated seat provided with a base seat and a jointing portion, which is provided with at least one connection surface; and at least one row of terminals comprising a grounding terminal, wherein the at least one row of terminals before being fixed to the insulated seat are arranged and connected to a material tape, wherein the material tape and the one row of terminals are formed by pressing the same metal sheet, the one row of terminals are fixed to the insulated seat and then separated from the material tape, the terminal is provided with a contact and a pin, the contact is exposed from the connection surface, and the pin extends out of the insulated seat;

characterized in that the material tape before being fixed to the insulated seat is integrally connected to at least one metal material sheet, and after the material tape is fixedly combined with the insulated seat, one end of the at least one metal material sheet is separated from the material tape to form one separated section exposed from the insulated seat, and the at least one metal material sheet is left and fixed to the insulated seat, wherein the at least one metal material sheet is insulated from all of the contacts of the terminals; or the at least one metal material sheet is electrically connected to only one of the terminals and is insulated from remaining ones of the contacts of the terminals; and wherein a metal housing covering the insulated seat is further provided, the jointing portion of the insulated seat is in the form of a tongue projecting beyond one end of the base seat, and a connection slot is formed within the metal housing, and the jointing portion is disposed in the connection slot.

2. The electrical connector according to claim 1, characterized in that the insulated seat is provided with a first seat and a second seat mutually stacked together, there are at least two rows of the terminals respectively disposed on the first and second seats, two opposite surfaces of the jointing portion are two connection surfaces, and the contacts of the at least two rows of terminals are respectively exposed from the two connection surfaces.

3. The electrical connector according to claim 2, characterized in that the electric connector satisfies one of (a) to (m) or a combination of more than one of (a) to (m):

(a) wherein a metal partition plate is provided between the first and second seats; or a metal partition plate is provided between the first and second seats, each of two sides of the metal partition plate is provided with a slot, and each of two sides of the jointing portion of the first and second seats is provided with a notch corresponding to the slot; or a metal partition plate is provided between the first and second seats, each of two sides of the metal partition plate is provided with a slot and a separated section, and each of two sides of the jointing portion of the first and second seats is provided with a notch corresponding to the slot;

(b) wherein two grounding sheets are further provided, the jointing portion has an inner section thicker than an outer section, so that the two connection surfaces of the inner section are in the form of two grounding convex surfaces, and the two grounding sheets are respectively in flat surface contact with the two grounding convex surfaces and are electrically connected to the metal housing; or wherein two grounding sheets are further provided, the jointing portion has an inner section thicker than an outer section, so that two connection surfaces of the inner section are in the form of two grounding convex surfaces, the grounding sheet has first and second plate sheets forming a ladder shape, and a vertical sheet between the first and second plate sheets and each of two sides is projectingly provided with a locking portion, the middle section of the top end of the vertical sheet is connected to the second plate sheet and each of the two sides is in the form of a separated section, the second plate sheet is in flat surface contact with an outer surface of the base seat, the first plate sheet is in flat surface contact with the grounding convex surface of the jointing portion, and the locking portion is locked to the base seat;

(c) wherein at least one row of contacts of the two connection surfaces of the jointing portion have the same contact interface; or wherein at least one row of contacts of the two connection surfaces of the jointing portion have the same contact interface, and the contact interfaces have connection points with circuit serial numbers arranged reversely; or wherein each of at least one row of contacts of the two connection surfaces of the jointing portion form a contact interface, and the contact interfaces have connection points with circuit serial numbers arranged reversely;

(d) wherein an external shape of the connection slot is top-bottom symmetrical and left-right symmetrical;

(e) wherein the contacts of the two rows of terminals are in flat surface contact with the two connection surfaces and are elastically non-movable;

(f) wherein a thickness of the base seat is larger than that of the jointing portion;

(g) wherein the jointing portion is disposed at a middle height of the connection slot, the two connection surfaces of the jointing portion form two symmetrical spaces, and the connection slot and the jointing portion can dock with an electrical connector in a dual-position bidirectional manner;

(h) wherein there are two rows of the terminals, and the contacts of the two rows of terminals are vertically aligned or staggered in a left-right direction;

(i) wherein the metal housing of an inlet of the connection slot is provided with at least one separated section;

(j) wherein two sides of the metal housing are provided with two locking sheet bent and locked into bottom ends of two sides of the insulated seat;

(k) wherein the at least two rows of terminals are respectively embedded and injection molded with or assembled with and fixed to the first and second seats;

(l) wherein at least two of the metal material sheets are provided on the first and second seats; and (m) wherein the electrical connector is a C-TYPE USB electrical connector socket.

4. The electrical connector according to claim 1, characterized in that the electric connector satisfies one of (a) to (k) or a combination of more than one of (a) to (k):

(a) wherein the insulated seat is provided with a metal partition plate; or the insulated seat is provided with a metal partition plate, each of two sides of the metal partition plate is provided with a slot, and each of two sides of the jointing portion is provided with a notch corresponding to the slot; or a metal partition plate is provided in the insulated seat, each of two sides of the metal partition plate is provided with a slot and a separated section, and each of two sides of the jointing portion is provided with a notch corresponding to the slot;

(b) wherein two grounding sheets are further provided, the jointing portion has an inner section thicker than an outer section, so that two opposite surfaces of the inner section are in the form of two grounding convex surfaces, and the two grounding sheets are respectively in flat surface contact with the two grounding convex surfaces and are electrically connected to the metal housing; or wherein two grounding sheets are further provided, the jointing portion has an inner section thicker than an outer section, so that two opposite surfaces of the inner section are in the form of two grounding convex surfaces, the grounding sheet has first and second plate sheets forming a ladder shape, and a vertical sheet between the first and second plate sheets and each of two sides is projectingly provided with a locking portion, the top end of the middle section of the vertical sheet is connected to the second plate sheet and each of the two sides is in the form of a separated section, the second plate sheet is in flat surface contact with an outer surface of the base seat, the first plate sheet is in flat surface contact with a grounding convex surface of the jointing portion, and the locking portion is locked to the base seat;

(c) wherein there are at least two rows of the terminals, two opposite surfaces of the jointing portion are the two connection surfaces, the contacts of the at least two rows of terminals are respectively exposed from the two connection surfaces, the at least one row of contacts of the two connection surfaces of the jointing portion have the same contact interface; or wherein there are at least two rows of the terminals, two opposite surfaces of the jointing portion are the two connection surfaces, the contacts of the at least two rows of terminals are respectively exposed from the two connection surfaces, the at least one row of contacts of the two connection surfaces of the jointing portion have the same contact interface, and the contact interfaces have connection points with circuit serial numbers arranged reversely; or wherein there are at least two rows of the terminals, two opposite surfaces of the jointing portion are the two connection surfaces, the contacts of the at least two rows of terminals are respectively exposed from the two connection surfaces, each of at least one row of contacts of the two connection surfaces of the jointing portion form a contact interface, and the contact interfaces have connection points with circuit serial numbers arranged reversely;

(d) wherein an external shape of the connection slot is top-bottom symmetrical and left-right symmetrical;

(e) wherein there are at least two rows of the terminals, two opposite surfaces of the jointing portion are the two connection surfaces, and the contacts of the at least two rows of terminals are respectively in flat surface contact with the two connection surfaces and are elastically non-movable;

(f) wherein a thickness of the base seat is larger than that of the jointing portion;

(g) wherein the jointing portion is disposed at a middle height of the connection slot, two symmetrical surfaces of the jointing portion form two symmetrical spaces, and the connection slot and the jointing portion can dock with an electrical connector in a dual-position bidirectional manner;

(h) wherein there are two rows of the terminals, two opposite surfaces of the jointing portion are the two connection surfaces, the contacts of the two rows of terminals are respectively exposed from the two connection surfaces, and the contacts of the two rows of terminals are vertically aligned or staggered in a left-right direction;

(i) wherein the metal housing of an inlet of the connection slot is provided with at least one separated section;

(j) wherein each of two sides of the metal housing is provided with a locking sheet is bent and locked into bottom ends of two sides of the insulated seat; and (k) wherein the at least one row of terminals are respectively embedded and injection molded with or assembled with and fixed to the insulated seat.

5. An electrical connector, comprising:

an insulated seat provided with a base seat and a jointing portion, which is provided with at least one connection surface; and at least one row of terminals comprising a grounding terminal, wherein the at least one row of terminals before being fixed to the insulated seat are arranged and connected to a material tape, wherein the material tape and the one row of terminals are formed by pressing the same metal sheet, the one row of terminals are fixed to the insulated seat and then separated from the material tape, the terminal is provided with a contact and a pin, the contact is exposed from the connection surface, and the pin extends out of the insulated seat;

characterized in that the material tape before being fixed to the insulated seat is integrally connected to at least one metal material sheet, and after the material tape is fixedly combined with the insulated seat, one end of the at least one metal material sheet is separated from the material tape to form one separated section exposed from the insulated seat, and the at least one metal material sheet is left and fixed to the insulated seat, wherein the at least one metal material sheet is insulated from all of the contacts of the terminals; or the at least one metal material sheet is electrically connected to only one of the terminals and is insulated from remaining ones of the contacts of the terminals; and wherein a metal housing covering the insulated seat is further provided, a connection slot is provided within the metal housing, the jointing portion rests against the metal housing and the at least one connection surface face the connection slot.

6. The electrical connector according to claim 5, characterized in that the jointing portion is provided with vertically separated two insulating substrates, two opposite surfaces of the two insulating substrates are the two connection surfaces, and the connection slot is formed between the two connection surfaces.

7. The electrical connector according to claim 6, characterized in that there are two rows of the terminals, and the contacts of the two rows of terminals are respectively exposed from the two connection surfaces to form two contact interfaces.

8. The electrical connector according to claim 7, characterized in that the base seat of the insulated seat and the jointing portion are mutually fitted with each other, the two rows of terminals are provided with vertically elastically movable extensions, the extension is projectingly provided with the contact, the two rows of terminals are fixedly disposed on the base seat, the extensions of the two rows of terminals extend out to locate in front of the base seat, the jointing portion is fitted with a front end of the base seat and covers the extensions of the two rows of terminals, and the contacts of the two rows of terminals project beyond the two connection surfaces, respectively, to form two contact interfaces.

9. The electrical connector according to claim 8, characterized in that the base seat is provided with a first seat and a second seat vertically stacked, and the two rows of terminals are respectively disposed on the first and second seats.

10. The electrical connector according to claim 9, characterized in that the electric connector satisfies one of (a) to (k) or a combination of more than one of (a) to (k):

(a) wherein two insulating substrates of the jointing portion are provided with multiple separated separation columns to form separated multiple slots so as to separate the extensions of the two rows of terminals;

(b) wherein the jointing portion is in the form of a fitting frame body to form the connection slot;

(c) wherein the two rows of terminals are respectively embedded and injection molded with or assembled with and fixed to the first and second seats;

(d) wherein the two contact interfaces are the same contact interface; or wherein the contact interfaces have connection points with circuit serial numbers arranged reversely; or wherein the two contact interfaces are the same contact interface and have connection points with circuit serial numbers arranged reversely;

(e) wherein a transversal extended metal partition plate is further provided between the first and second seats so as to separate the two rows of terminals, each of left and right sides of the metal partition plate is integrally provided with a resilient snap that is elastically movable in a left-right direction, and the resilient snaps are provided with two projections disposed on left and right sides of the connection slot; or wherein a transversal extended metal partition plate is further provided between the first and second seats so as to separate the two rows of terminals, each of left and right sides of the metal partition plate is integrally provided with a resilient snap that is elastically movable in a left-right direction, and the two resilient snaps are provided with projections disposed on left and right sides of the connection slot and have outer sides each provided with a separated section;

(f) wherein a transversal extended metal partition plate is further provided between the first and second seats so as to separate the two rows of terminals;

(g) wherein a transversal extended metal partition plate is further provided between the first and second seats so as to separate the two rows of terminals, and the metal partition plate is provided with at least one pin extending out of the base seat;

(h) wherein inner and outer shapes of the jointing portion are top-bottom symmetrical and left-right symmetrical;

(i) wherein at least two grounding sheets are further provided, the at least two grounding sheets are electrically connected to the metal housing and provided with at least one vertically elastically movable contact, and the contacts of the at least two grounding terminals respectively project beyond two front sections of the two connection surfaces and are disposed in the connection slot; or wherein at least two grounding sheets are further provided, the at least two grounding sheets are electrically connected to the metal housing and provided with at least one vertically elastically movable contact, the contacts of the at least two grounding sheets respectively project beyond two front sections of the two connection surfaces and are disposed in the connection slot, and each of two sides of the at least two grounding sheets is provided with a separated section;

(j) wherein the rear end of the metal housing is provided with at least one separated section; and (k) wherein at least two of the metal material sheets are provided on the first and second seats.

11. The electrical connector according to claim 7, characterized in that the electric connector satisfies one of (a) to (h) or a combination of more than one of (a) to (h):

(a) wherein the two rows of terminals are respectively embedded and injection molded with or assembled with and fixed to the insulated seat;

(b) wherein the two contact interfaces are the same contact interface; or wherein the contact interfaces have connection points with circuit serial numbers arranged reversely; or wherein the two contact interfaces are the same contact interface and have connection points with circuit serial numbers arranged reversely;

(c) wherein a transversal extended metal partition plate is further provided in the insulated seat so as to separate the two rows of terminals, each of left and right sides of the metal partition plate is integrally provided with a resilient snap that is elastically movable in a left-right direction, and the resilient snaps are provided with two projections disposed on left and right sides of the connection slot; or wherein a transversal extended metal partition plate is further provided between the first and second seats so as to separate the two rows of terminals, each of left and right sides of the metal partition plate is integrally provided with a resilient snap that is elastically movable in a left-right direction, and the two resilient snaps are provided with two projections disposed on left and right sides of the connection slot and have outer sides each provided with a separated section;

(d) wherein a transversal extended metal partition plate is further provided in the insulated seat so as to separate the two rows of terminals;

(e) wherein a transversal extended metal partition plate is further provided in the insulated seat so as to separate the two rows of terminals, and the metal partition plate is provided with at least one pin extending out of the base seat;

(f) wherein inner and outer shapes of the jointing portion are top-bottom symmetrical and left-right symmetrical, and the connection slot and the jointing portion can dock with an electrical connector in a dual-position bidirectional manner;

(g) wherein at least two grounding sheets are further provided, the at least two grounding sheets are electrically connected to the metal housing and provided with at least one vertically elastically movable contact, and the contacts of the at least two grounding terminals respectively project beyond two front sections of the two connection surfaces and are disposed in the connection slot; or wherein at least two grounding sheets are further provided, the at least two grounding sheets are electrically connected to the metal housing and provided with at least one vertically elastically movable contact, the contacts of the at least two grounding sheets respectively project beyond two front sections of the two connection surfaces and are disposed in the connection slot, and each of two sides of the at least two grounding sheets is provided with a separated section; and (h) wherein a rear end of the metal housing is provided with at least one separated section.

12. The electrical connector according to claim 7 being a C-TYPE USB electrical connection plug.

13. An electrical connector, comprising:

an insulated seat provided with a base seat and a jointing portion, which is provided with at least one connection surface; and at least one row of terminals comprising a grounding terminal, wherein the at least one row of terminals before being fixed to the insulated seat is arranged and connected to a material tape, wherein the material tape and the one row of terminals are formed by pressing the same metal sheet, the one row of terminals are fixed to the insulated seat and then separated from the material tape, the terminal is provided with a contact and a pin, the contact is exposed from the connection surface, and the pin extends out of the insulated seat;

characterized in that the material tape before being fixed to the insulated seat is provided with at least one metal material sheet, and after the material tape is connected to the insulated seat, the insulated seat is separated from the at least one metal material sheet to form at least one slot, and the at least one slot is open on an edge of the insulated seat, wherein the at least one metal material sheet is insulated from all of the contacts of the terminals; or the at least one metal material sheet is electrically connected to only one of the terminals and is insulated from remaining ones of the contacts of the terminals.

14. The electrical connector according to claim 13, characterized in that the at least one row of terminals are embedded and injection molded with the insulated seat, and the at least one slot is vertically depressed and is open to the outside in one of upward and downward directions.

15. The electrical connector according to claim 14, characterized in that top and bottom surfaces of the insulated seat are provided with a vertical-direction through hole penetrating to the slot.

16. The electrical connector according to claim 13, characterized in that the electric connector satisfies one of (a) to (n) or a combination of more than one of (a) to (n):

(a) wherein there are at least two of the slots disposed on left and right sides of the base seat of the insulated seat;

(b) wherein there are at least two of the slots open to the outside on two sides of a rear end of the insulated seat;

(c) wherein there are at least two of the slots open to the outside on left and right side edges of the insulated seat;

(d) wherein there are at least two of the slots respectively disposed on two outer sides of the at least one row of terminals;

(e) wherein the electrical connector is an electrical connector plug;

(f) wherein the electrical connector is an electrical connector socket;

(g) wherein the at least one row of terminals are embedded and injection molded with the insulated seat;

(h) wherein the insulated seat is made of a plastic material; and (i) wherein multiple distal sections of the pins of the at least one row of terminals are horizontal or vertical.

* * * * *